US005856063A

United States Patent [19]

Hirai et al.

[11] Patent Number: 5,856,063

[45] Date of Patent: Jan. 5, 1999

[54] IMAGE FORMING METHOD

[75] Inventors: Hiroyuki Hirai; Takashi Nakamura; Kiyoteru Miyake, all of Kanagawa, Japan

[73] Assignee: Fuji Photo Film Co., Ltd., Kanagawa, Japan

[21] Appl. No.: 878,774

[22] Filed: Jun. 19, 1997

[30] Foreign Application Priority Data

Jun. 21, 1996 [JP] Japan ..... 8-161561
Jul. 19, 1996 [JP] Japan ..... 8-190475

[51] Int. Cl.[6] ..... G03C 8/06; G03C 8/28; G03C 8/40

[52] U.S. Cl. ..... 430/203; 430/206; 430/231; 430/232; 430/234; 430/353; 430/404

[58] Field of Search ..... 430/203, 206, 430/232, 404, 353, 231, 234

[56] References Cited

U.S. PATENT DOCUMENTS

| | | | |
|---|---|---|---|
| 4,639,407 | 1/1987 | Aono et al. | 430/203 |
| 4,876,171 | 10/1989 | Hirai | 430/203 |
| 5,677,104 | 10/1997 | Hirai et al. | 430/203 |
| 5,700,622 | 12/1997 | Hirai et al. | 430/203 |
| 5,725,990 | 3/1998 | Hirai et al. | 430/203 |

FOREIGN PATENT DOCUMENTS

| | | |
|---|---|---|
| 60-194448 | 10/1985 | Japan . |
| 62-283332 | 12/1987 | Japan . |
| 63-198050 | 8/1988 | Japan . |

OTHER PUBLICATIONS

JP 62–283332 (Derwent Abstract), Dec. 1987.
JP 63–198050 (Derwent Abstract), Aug. 1988.
JP 60–194448 (Derwent Abstract), Oct. 1985.

*Primary Examiner*—Richard L. Schilling
*Attorney, Agent, or Firm*—Sughrue, Mion, Zinn, Macpeak & Seas, PLLC

[57] ABSTRACT

An image forming method comprising the steps of: (i) imagewise exposing a silver halide light-sensitive material comprising a support having thereon at least a light-sensitive silver halide emulsion, a hydrophilic binder and a slightly water-soluble basic metal compound; (ii) laminating the silver halide material with a processing sheet comprising a compound which forms a complex with a metal ion constituting the basic metal compound, a physical development nucleus, a solvent for a silver halide and a matting agent, after or concurrently with the imagewise exposure; and (iii) conducting heat development in the presence of a reducing agent and water to form a silver image on at least one of the light-sensitive material and the processing sheet, wherein the processing sheet comprises an uppermost layer containing the physical development nucleus; the product of the weight ratio in the uppermost layer of the amount of the physical development nucleus to that of the binder and the reciprocal of the mean size ($\mu$m) of the physical development nucleus is not less than 1.5; the amount of the binder in the uppermost layer is from 0.001 g/m$^2$ to 0.8 g/m$^2$; and the uppermost layer has a contact angle with respect to water of not more than 60°.

2 Claims, No Drawings

IMAGE FORMING METHOD

FIELD OF THE INVENTION

The present invention relates to an image forming method using a silver halide light-sensitive material. Particularly, the invention relates to an image forming method using a processing sheet for a heat developable light-sensitive material, which can provide a black-and-white image having good image quality such as high density and less fog and excellent image storage characteristics within a short period of time.

BACKGROUND OF THE INVENTION

Photographic methods using silver halides are excellent in photographic characteristics such as sensitivity, gradation control and resolving power, as compared with other photographic methods such as electrophotographic methods and diazo photographic methods, and therefore have previously been most widely used.

At present, image information has been largely shifted from black-and-white images to color images because of a great deal of information and expressing easiness. However, black-and-white images are still preferably used in specific fields such as the medical field. Further, in the print field, plate making materials for color images are also used as black-and-white images for each printing ink. Thus, there are still great demands for the black-and-white images mainly in the industrial use.

In recent years, systems which can readily and rapidly provide images have been developed in accordance with the shift of image formation processing using light-sensitive materials containing silver halides from conventional wet processing to instant systems containing developing solutions and further to dry heat development processing by means of heating, also in view of environmental protection. Such heat developable black-and-white light-sensitive materials are described, for example, in *Shashin Kohqaku no Kiso* (*Higinen Shashin*) (The Fundamentals of Photographic Engineering (Nonsilver Photograph)), pages 242 to 255 (1982), Corona Publishing Co. Ltd., JP-B-43-4921 (the term "JP-B" as used herein means an "examined Japanese patent publication") and JP-B-43-4924. As for commercial products of the black-and-white system, "Dry Silver" light-sensitive materials are put on the market by Minnesota Mining and Manufacturing Co.

In monosheet light-sensitive materials comprising a silver halide, an organic silver salt and a reducing agent, such as Dry Silver light-sensitive materials, unused silver halide and organic silver salt remain in heat-developed images. The light-sensitive materials are therefore disadvantageous in that the residual silver halides or organic silver salts are printed out to cause coloration of white backgrounds, resulting in loss of contrast, when they are exposed to strong light or stored for a long period of time. They are further disadvantageous in that the light-sensitive materials before processing have poor storability, because a reducing agent and a silver halide coexist in the same light-sensitive material.

Further, a method for obtaining black color images by dry processing is described in *Research Disclosure* (hereinafter abbreviated as "RD"), No. 17326, pages 49 to 51 (September, 1978). However, this system also has the same disadvantage as described above, because it is also of unfixing type containing silver and silver salts in color images.

In order to overcome these disadvantages, JP-B-3-78617 and JP-B-3-45820 are disclose methods for forming black-and-white images, in which mobile (diffusible) dyes are imagewise formed or released by heating, and then transferred to a dye fixing material containing a dye accepting material such as mordants, a heat-resistant organic polymer, etc. using various transferring solvents, thereby improving image storability. However, in these methods, transfer is conducted after heat development, so that the number of steps is increased and the processing time is prolonged.

Further, JP-A-3-260645 (the term "JP-A" as used herein means an "unexamined published Japanese patent application") discloses a heat development transfer type black-and-white image forming method utilizing a coupling reaction, including a method of conducting transfer after development and a method of conducting development and transfer at the same time. However, these methods also require a long period of time and a high temperature for processing because of the absence of a development transfer accelerator.

JP-A-62-129848 discloses that black-and-white images of transferred dye images can be formed by conducting heat development using a small amount of water. However, in order to obtain images having a transmission density of 2 or more, preferably 3 or more, which are required for most black-and-white images, by dye transfer methods within a short period of time, it is necessary to reduce the film thickness of a light-sensitive material, particularly to make the amount of a binder as small as possible, and to increase the amount of a dye-donating compound used. This raises the problems of lowered quality of the film and increased cost. Further, this introduces the problem that the use thereof is limited because of a reduction in sharpness due to transfer. Furthermore, it is difficult to synthesize black dye-donating compounds, and it is also difficult to obtain neutral gray color images by mixing yellow, magenta and cyan dye-donating compounds.

In addition, methods for forming silver images by a heat development silver salt diffusion transfer method using a silver halide light-sensitive material and a processing sheet are disclosed in JP-A-62-283332, JP-A-63-198050 and JP-A-60-194448. However, these methods are also methods utilizing transferred silver images. It is therefore difficult to obtain images having a transmission density of 2 or more, preferably 3 or more, and a high sharpness within a short period of time, and improvements have been required.

Further, it has become clarified that the introduction of a matting agent into a photographic element (particularly, a processing sheet) used in this image forming method for prevention of adhesion after coating and winding-up steps raises the problem of an increase in Dmin.

When the amount of a solvent for a silver halide is increased, or a solvent for a silver halide having a high stability constant with respect to silver are used for decreasing Dmin, Dmin is decreased, but Dmax is also decreased. This results from the occurrence of dissolution physical development in exposed areas, or an decrease in the amount of developed silver by the transfer of silver to a processing sheet.

SUMMARY OF THE INVENTION

An object of the present invention is to provide an image forming method which can provide a black-and-white image having less fog, a high Dmax and excellent image storability, and free from image density unevenness within a short period of time.

Other objects and effects of the present invention will become apparent from the following description.

The above objectives of the present invention has been achieved by providing an image forming method comprising the steps of:

(i) imagewise exposing a silver halide light-sensitive material comprising a support having thereon at least a light-sensitive silver halide emulsion, a hydrophilic binder and a slightly water-soluble basic metal compound;

(ii) laminating the silver halide material with a processing sheet comprising a compound which forms a complex with a metal ion constituting the basic metal compound, a physical development nucleus, a solvent for a silver halide and a matting agent, after or concurrently with the imagewise exposure; and (iii) conducting heat development in the presence of a reducing agent and water to form a silver image on either or both of the light-sensitive material and the processing sheet, wherein the processing sheet comprises an uppermost layer containing the physical development nucleus;

wherein the product of the weight ratio in the uppermost layer of the amount of the physical development nucleus to that of the binder and the reciprocal of the mean size ($\mu$m) of the physical development nucleus is not less than 1.5;

wherein the amount of the binder in the uppermost layer is from 0.001 g/m$^2$ to 0.8 g/m$^2$; and wherein the uppermost layer has a contact angle with respect to water of not more than 60°.

In a preferred embodiment, the silver halide light-sensitive material contains a 1-phenyl-3-pyrazolidone compound and a 5-pyrazolidone compound in at least one of the light-sensitive silver halide emulsion layer or other hydrophilc binder layers.

DETAILED DESCRIPTION OF THE INVENTION

In the image forming method of the present invention, a method comprising laminating a silver halide light-sensitive material with a processing sheet after or concurrently with imagewise exposure, and conducting heat development in the presence of a reducing agent and water is utilized. As a result of the heat development, in unexposed areas, an undeveloped silver halide is dissolved by a solvent for a silver halide to form a silver ion complex, which is transferred onto the processing sheet together with the reducing agent, and then physically developed on a physical development nucleus. Therefore, fixing of the unexposed areas is conducted in the absence of remaining undeveloped silver halides. In exposed areas, a silver halide in which a latent image is formed is developed with the reducing agent to produce a silver image.

In the present invention, the physical development nucleus is located in the uppermost layer of the processing sheet, the amount of a binder contained in the physical development nucleus-containing layer is reduced, and the product of the number density of the physical development nuclei and the total surface area thereof is increased, thereby providing effects of enhancing the physical development activity of the processing sheet and of decreasing Dmax without decreasing Dmin.

Further, the present invention provides an effect of reducing the occurrence of image density unevenness (particularly, density unevenness in a Dmin area). The present inventors have traced that the image density unevenness is caused by the wettability of the processing sheet with respect to water and the unevenness of its surface due to matting agents. It is considered that the poor wettability of the processing sheet or the unevenness of the surface is liable to cause variations in the amount of water absorbed in the vicinity of the surface of the processing sheet, and the sensitivity to changes in the amount of water is enhanced by an increase in physical development activity, to thereby tend to develop the density unevenness. When the vicinity of the surface are densely filled with hydrophobic physical development nuclei as in the present invention, the wettability with respect to water is deteriorated. Although the unevenness of the surface are necessary and indispensable in view of prevention of adhesion, the contact angle with water is decreased to improve the wettability with respect to water, whereby the density unevenness in the Dmin areas has been able to be eliminated without changing Dmin and Dmax. It is supposed that an improvement in wettability homogenizes the water absorption of the processing sheet so that physical development is uniformly conducted in the surface of the processing sheet, to thereby remove occurrence of the density unevenness.

The "contact angle with respect to water" is a measure of the wettability as described in *Test Methods and Evaluation of Polymer Materials*, page 325, edited by Kobunshi Gakkai). That is, a smaller contact angle shows easier wetting, whereas a larger contact angle shows more difficult wetting.

The contact angle of the uppermost layer of the processing sheet of the present invention with respect to water is 60° C. or less, and preferably 4° C. or less.

The contact angle of the uppermost layer with respect to water can be controlled by various formulation factors. For example, the contact angle can be controlled with various surfactants, binders, hardeners or polymers, described below. In particular, a surfactant, a binder or a polymer in the uppermost layer largely contributes thereto, and especially, the contact angle can be effectively controlled by a surfactant. Specific examples thereof are described in JP-A-62-173463 and JP-A-62-183457. It is particularly preferred to use fluorine surfactants, and effective examples thereof include compounds described in JP-B-57-9053, columns 8 to 17, JP-A-61-20944 and JP-A-62-135826, perfluoroalkylaminosulfonic acid salts and perfluoroalkylaminocarboxylic acid salts. These surfactants can be used alone or in combination. When the fluorine surfactants are used, the addition amount is preferably 0.1 mg/m$^2$ to 100 mg/m$^2$, and more preferably 1 mg/m$^2$ to 50 mg/m$^2$.

The physical development nuclei for use in the processing sheet of the present invention reduce a soluble silver salt diffused from the light-sensitive material to convert it to physical development silver, and thus fix it to the processing sheet. Any known physical development nuclei can be used, as the physical development nuclei for use in the present invention. Examples thereof include colloidal particles of: heavy metals such as zinc, mercury, lead, cadmium, iron, chromium, nickel, tin, cobalt, copper and ruthenium; noble metals such as palladium, platinum, silver and gold; and chalcogen compounds such as sulfur, selenium and tellurium compounds of these metals. These physical development nuclei may be used as a combination of two or more thereof.

When the physical development nuclei are metals, they may be solid solutions such as alloys (for, example, gold-silver, bronze, brass and gold-palladium). In the case of chalcogen compounds, they may be solid solutions such as silver gold sulfide (AgAuS, etc) and silver sulfide selenide ($Ag_4SSe$).

The physical development nuclei may have a structure. For example, it is preferred that the surface of silver colloids are covered with, or epitaxially joined to, a metal such as gold, palladium and iridium or an alloy. Fine particles are also preferably used in which a chalcogen compound such as silver sulfide and silver selenide are joined to colloids of silver, gold or palladium by epitaxial junction. The physical development nuclei may be in a state in which they are adsorbed by matrixes such as colloidal silica. The physical development nuclei may be either crystalline or amorphous.

These physical development nucleus substances can be obtained by reducing the corresponding metal ion with a reducing agent such as ascorbic acid, sodium boron hydride, hydroquinone and dextrin to produce a metal colloidal dispersion, or by mixing the metal ion with a solution of a soluble sulfide, selenide or telluride to produce a colloidal dispersion of a water-insoluble metal sulfide, metal selenide or metal telluride. These dispersions are preferably formed in a hydrophilic binder such as gelatin. Methods for preparing a colloidal silver grain are described in U.S. Pat. No. 2,688,601. The salt removal methods for removing excess salts, which are known in the preparation of silver halide emulsions, may be carried out as needed. Sedimentation methods using phthalated gelatin or carbamoylated gelatin are preferably conducted.

Physical development nuclei having a mean particle size of 0.2 $\mu$m to 0.002 $\mu$m are preferably used as the physical development nuclei for use in the present invention. For the particle size distribution, monodisperse systems are preferred. Two or more of particles different in mean particle size may be mixed. The particle size distribution of the physical development nucleus can be controlled by changing the rate of addition of the metal ion, the reducing agent or the chalcogenide solution, the kind of reducing agent (reduction potential), the kind of compound which forms a complex with the metal ion (stability constant), or the viscosity, the pH or the temperature of the solution used in the preparation.

The size of these physical development nuclei can be measured by use of an electron microscope. In order to measure the accurate particle size distribution, it is necessary to exactly determine the enlargement magnification using a grating having a known definite spacing. The size of the physical development nucleus as used in the present invention is represented by the diameter of a circle having an area equivalent to a projected areas of the nucleus (the diameter of a projected area-corresponding circle).

When the physical development nucleus is crystalline, not amorphous, the size can also be estimated by the Scherrer equation using the half-value width of a diffraction profile of X-ray diffraction. If a calibration curve is made with respect to the relationship between the size obtained under an electron microscope and the size determined from the half-value width, the particle size of the physical development nucleus defined in the present invention can be easily obtained even by X-ray diffraction.

These physical development nuclei are added to the processing sheets usually in an amount of $10^{-3}$ mg/m$^2$ to 100 mg/m$^2$, and preferably in an amount of $10^{-2}$ mg/m$^2$ to 30 mg/m$^2$.

Layers containing the physical development nuclei are located as the uppermost layer of the processing sheet for use in the present invention.

A binder for use in the layer containing the physical development nuclei is preferably a hydrophilic binder. Examples thereof include binders described in *RD* 17643, page 26, *RD* 18716, page 651, *RD* 307105, pages 873 to 874, and JP-A-64-13546, pages 71 to 75. Specifically, transparent or translucent hydrophilic binders are preferred, and examples thereof include natural compounds such as proteins (for example, gelatin and gelatin derivatives), polysaccharides (for example, cellulose derivatives, agar, starch, gum arabic, dextran, pullulan, furcellaran, carageenan described in EP-A-443,529, low cast bean gum, xanthan gum and pectin) and polysaccharides described in JP-A-1-221736; and synthetic polymers such as polyvinyl alcohol, modified alkyl polyvinyl alcohols described in JP-A-7-219113, polyvinylpyrrolidone and polyacrylamide. Further, there can also be used high water-absorptive polymers described in U.S. Pat. No. 4,960,681 and JP-A-62-245260, namely homopolymers of vinyl monomers having —COOM or —$SO_3$M (wherein M represents a hydrogen atom or an alkali metal), or copolymers of these vinyl monomers with each other or with other monomers (for example, sodium methacrylate, ammonium methacrylate and Sumikagel L-5H manufactured by Sumitomo Chemical Co, Ltd.). These binders can be used in combination. Combinations of gelatin and the above-described binders are preferred. As to gelatin, lime-treated gelatin, acid-treated gelatin and so-called delimed gelatin reduced in content of calcium, gelatin derivatives such as phthalated gelatin, carbamoylated gelatin and esterified gelatin, low-molecular gelatin, gelatin oxidized with an oxidizing agent such as hydrogen peroxide, and enzyme-treated gelatin described in *Bull. Soc. Photo. Japan*, 16, 30 (1966) can be used, depending on various purposes.

The physical development nuclei separately prepared can be added to a coating solution. However, for example, silver nitrate and sodium sulfide, or chloroauric acid and a reducing agent may be reacted with each other in a coating solution containing a hydrophilic binder to produce the physical development nucleus.

The physical development nuclei are preferably silver, silver sulfide or palladium sulfide. When physical development silver transferred onto the processing sheet is used as an image, palladium sulfide and silver sulfide are preferably used in terms of decreased Dmin and high Dmax.

The product (b/ac) of the weight ratio (b/a), in the uppermost layer, of (b) the amount of the physical development nucleus to (a) that of the binder and the reciprocal (1/c) of the mean size (c $\mu$m) of the physical development nucleus is 1.5 or more, and preferably 10 or more. This value is an amount corresponding to the product of the number density of the physical development nuclei per binder and the total surface area thereof, and considered to be related to the physical development activity.

The binder amount in the physical development nucleus-containing layer is 0.001 g/m$^2$ to 0.8 g/m$^2$, and preferably 0.001 g/m$^2$ to 0.1 g/m$^2$. In the present invention, it is preferred that this layer is thin, but the lower limit is 0.001 g/m$^2$ from the viewpoint of the coating properties.

In the present invention, the physical development nucleus-containing layers may contain azaindene compounds (for example, triazaindenes, tetraazaindenes (particularly, 4-hydroxy-6-methyl(1,3,3a,7)tetraazaindenes) and pentaazaindenes); thiazolium compounds; mercapto compounds (for example, mercaptotetrazole, mercaptothiadiazole, mercaptooxadiazole, thiosalicylic acid, mercaptoacetic acid, mercaptotriazole and mercaptooxazole); benzotriazole; benzimidazole; and benzopyrazole. These additives may be adsorbed by the physical development nuclei or present in the binder without adsorption. The addition amount thereof is preferably 0.0001 g/m$^2$ to 1 g/m$^2$, more preferably 0.0001 g/m$^2$ to 0.1 g/m$^2$, and most preferably 0.001 g/m$^2$ to 0.01 g/m$^2$, based on the processing sheet. These additives have the effect of controlling the color tone of images, when the physical development silver images of the processing sheets are used as images.

In the present invention, various inorganic compounds and organic compounds, particularly polymer particles, are used as matting agents. The inorganic matting agents include oxides such as silicon dioxide, colloidal silica, titanium oxide and aluminum oxide; alkaline earth metal salts such as barium sulfate, calcium carbonate and magnesium sulfate; and glass particles such as silicates, phosphates and borates. The organic matting agents include compounds such as benzoguanamine resin beads, polycarbonate resin beads and AS resin beads described in JP-A-63-274944; and compounds described in *RD* 307105, pages 878–879, as well as natural compounds such as cornstarch, cellulose esters and cellulose ethers, and modified products thereof; synthetic resins such as alkyl acrylates, alkyl methacrylates, acrylamides, vinyl esters and styrene compounds; and polyolefins and polymethacrylates described in JP-A-61-88256, page 29. Materials having voids or porous surfaces as described in JP-A-3-109542 and JP-A-64-31149 may also be used.

These matting agents are preferably used in the uppermost layer (protective layer), but they can also be added to lower layers as needed.

In the present invention, the above described matting agents may be used either alone or as a combination of two or more thereof. The mean particle size of the matting agent used in the present invention is preferably 0.1 $\mu$m to 20 $\mu$m. The amount of the matting agent added is preferably 1% to 40%, and more preferably 2% to 20% by weight ratio, based on the weight of the binder.

In the present invention, known solvents for silver halides can be used as the solvent for a silver halide for use in the present invention. Examples thereof include thiosulfates such as sodium thiosulfate and ammonium thiosulfate; sulfites such as sodium sulfite and sodium hydrogensulfite; thiocyanates such as potassium thiocyanate and ammonium thiocyanate; thioether compounds such as 1,8-di-3,6-dithiaoctane, 2,2'-thiodiethanol and 6,9-dioxa-3,12-dithiatetradecane-1,14-diol described in JP-B-47-11386; thiourea compounds described in JP-A-53-82408, JP-A-55-77737 and JP-A-55-2982, compounds having 5- or 6-membered imido rings such as uracil and hydantoin described in JP-A-8-179458; imidazole compounds described in JP-A-54-100717; and compounds represented by the following general formula described in JP-A-53-144319:

$$N(R_1)(R_2)—C(=S)—X—R_3$$

wherein X represents a sulfur atom or an oxygen atom; $R_1$ and $R_2$, which may be the same or different, each represents an aliphatic group, an aryl group, a heterocyclic ring residue or an amino group; $R_3$ represents an aliphatic or an aryl group; $R_1$ and $R_2$, or $R_2$ and $R_3$ may combine together to form a 5- or 6-membered heterocyclic ring. Trimethylazolium thiolate and mesoionic thiolate compounds described in *Analytica Chemica Acta*, 248, 604–614 (1991) are also preferred. Compounds described in JP-A-8-069097 which can fix silver halides to stabilize them can also be used as the solvents for silver halides. The above-described solvents for silver halides may be used as a combination of two or more of them.

The common logarithm of the reciprocal of the solubility product, Ksp (=$[Ag^+]^i[L^{-i}]$), of the solvent for a silver halide L with respect to silver Ag is preferably 11 or less, in the case of i=1, and preferably 20 or less, in the case of i=2. The stability constant βn (=[AgLn]/[Ag][L]n) of silver complex ions can be up to n=4. The common logarithm of the stability constant is preferably 5 to 14.

These values are described in T. H. James, *The Theory of the Photographic Process*, the fourth edition, chapter 1, Macmillan (1977) and *Stability Constants of Metal-ion Complexes "Pergamon Press"* edited by IUPAC.

In the present invention, of the above-described compounds, sulfites and compounds having 5- or 6-membered imido rings such as uracil and hydantoin are particularly preferred.

The solvent for a silver halide for use in the present invention may be contained in any layers of the processing sheet, but is preferably contained in the uppermost layer thereof.

The total amount of the solvents for a silver halide contained in the processing sheet for use in the present invention is generally 0.01 mmol/$m^2$ to 50 mmol/$m^2$, preferably 0.1 mmol/$m^2$ to 30 mmol/$m^2$, and more preferably 1 mmol/$m^2$ to 20 mmol/$m^2$. The amount is generally 1/20 to 20 times, preferably 1/10 to 10 times, and more preferably 1/3 to 3 times the amount of silver coated of the light-sensitive material in terms of molar ratio. The solvent for a silver halide may be added to solvents such as water, methanol, ethanol, acetone, dimethylformamide and methyl propyl glycol, or alkalis, or acidic aqueous solutions, or may be dispersed to form a solid grain dispersion followed by the addition of the dispersion to a coating solution.

In the present invention, the processing sheet may contain a polymer having repeating units of vinylimidazole and/or vinylpyrrolidone described in JP-A-8-069097, whereby the density of a silver image on the light-sensitive material can be increased.

Combinations of the slightly water-soluble basic metal compound used as a base precursor and the compound (complex forming compound or complexing agent) which can undergo complex formation with the metal ion constituting the basic metal compound for use in the present invention are disclosed in JP-A-62-129848, EP-A-210,660 and U.S. Pat. No. 4,740,445.

Preferred examples of the basic metal compound include oxides, hydroxides and basic carbonates of zinc or aluminum, and zinc oxide, zinc hydroxide and basic zinc carbonate are particularly preferred.

In order to introduce the slightly water-soluble basic metal compound into the light-sensitive material, the basic metal compound is preferably dispersed in a hydrophilic binder as fine particles, as described in JP-A-59-174830. The mean particle size of the fine particles is 0.001 $\mu$m to 5 $\mu$m, and preferably 0.01 $\mu$m to 2 $\mu$m. The amount of the basic metal compound contained in the light-sensitive material is generally 0.01 g/$m^2$ to 5 g/$m^2$, and preferably 0.05 g/$m^2$ to 2 g/$m^2$.

The complex forming compound for use in the processing sheet with respect to the metal ion of the slightly water-soluble basic metal compound is known as a chelating agent in analytical chemistry and as a water softener in photochemistry. Details thereof are described in A. Ringbom, translated by Nobuyuki Tanaka and Haruko Sugi, *Complex Formation* (Sangyo Tosho), as well as the above-described patent specifications. Preferred examples of the complex forming compound for use in the present invention include aminopolycarboxylic acids (including salts thereof) such as ethylenediaminetetraacetic acid, nitrilotriacetic acid and diethylenetriaminepentaacetic acid, aminophosphonic acids (including salts thereof) such as amino-tris (methylenephosphonic acid) and ethylenediaminetetramethylenephosphonic acid, and pyridinecarboxylic acids (including salts thereof) such as 2-picolinic acid, pyridine-2,6-dicarboxylic acid and 5-ethyl-2-picolinic acid. Of these, pyridinecarboxylic acids and salts thereof are particularly preferred.

The complex forming compound for use in the present invention may be contained in any layers of the processing sheet, but is preferably contained in the uppermost layer thereof.

In the present invention, it is preferred that the complex forming compound is used as a salt neutralized with a base. In particular, salts with organic bases such as guanidines, amidines and tetraalkylammonium hydroxides, and salts with alkali metals such as sodium, potassium and lithium are preferably used. They may be used as mixtures thereof. Preferred examples of the complex forming compounds are described in JP-A-62-129848 and EP-A-210,660 described above. The amount of the complexing agent contained in the processing sheet is 0.01 $g/m^2$ to 10 $g/m^2$, and preferably 0.05 $g/m^2$ to 5 $g/m^2$.

Silver halide grains which can be used in the present invention are silver halides having a silver chloride content of 70 mol % or more, such as silver chloride, silver iodochloride, silver chlorobromide and silver iodochlorobromide. The content of silver iodide is preferably 10 mol % or less, more preferably 1 mol % or less, and most preferably 0.5 mol % or less.

The silver halide emulsion for use in the present invention may be either a surface latent image type emulsion or an internal latent image type emulsion. The internal latent image type emulsions are used as direct reversal emulsions in combination with nucleating agents or light fogging. Further, they may be multiple-structure grains in which the insides of grains are different from the surfaces thereof in terms of the halogen composition, and silver halides different in composition may be joined by epitaxial junction.

Silver halide grains having silver bromide-localized phases in the insides and/or on surfaces thereof in a layer form or in a non-layer form can also be used. For the halogen composition of the above-described localized phases, the silver bromide content is preferably at least 20 mol %, and more preferably above 30 mol %. The silver bromide content of the silver bromide-localized phases is measured by X-ray diffraction. For example, application of X-ray diffraction to silver halide grains is described in C. R. Berry and S. J. Marino, *Photographic Science and Technology*, 2, 149 (1955) and ibid., 4, 22 (1957). The silver bromide-localized phases can exist inside the grains, on edges and corners of surfaces of the grains, and on the surfaces thereof. Preferred examples thereof include localized phases formed on the corner portions of the grains by epitaxial junction.

The silver halide grains can be used, selected from normal crystals free from twin planes, a single twin containing one twin plane, parallel multiple twins containing two or more parallel twin planes, non-parallel multiple twins containing two or more non-parallel twin planes, spherical grains, potato-like grains, tabular grains having a high aspect ratio and combined systems thereof according to their purpose. The form of twin grains is described in *Shashin Kohqaku no Kiso* (*Ginen Shashin*) (The Fundamentals of Photographic Engineering (Silver Photograph)), page 163, edited by Nippon Shashin Gakkai, Corona Publishing Co. Ltd.

In the case of normal crystals, the grains having the cubic form comprising a (100) face, the octahedral form comprising a (111) face, and the dodecahedral form comprising a (110) face can be used. The dodecahedral grains are described in JP-B-55-42737 and JP-A-60-222842, and further reported in *Journal of Imaging Science*, 30, 247 (1986). Grains having (hll) faces, (hhl) faces, (hk0) faces and (hkl) faces can also be used according to their purpose. Tetradecahedral grains having (111) and (100) faces and grains having (111) and (110) faces can also be utilized. Polyhedral grains such as octatriacontahedral grains, deformed rhombic tetracosahedral grains, hexatetracontahedral grains and octahexacontahedral grains can also be used as needed.

Tabular grains having a high aspect ratio can also be preferably used. Tabular grains of high silver chloride emulsion grains having (111) faces are described in U.S. Pat. Nos. 4,399,215, 4,400,463 and 5,217,858, and JP-A-2-32. Further, an empirical rule of tabular grain formation of silver chloride is also reported in *Journal of Photographic Science*, 36, 182 (1988). Tabular grains of high silver chloride emulsion grains having (100) faces are described in U.S. Pat. Nos. 4,946,772, 5,275,930 and 5,264,337, JP-A-4-214109, JP-A-6-308648 and EP-A-534,395.

Such grains having a high aspect ratio are larger in their surface area than normal crystals having the same volume, so that the amount of sensitizing dyes adsorbed can be increased. This is advantageous in terms of color sensitization sensitivity. Further, this is advantageous in terms of covering power, so that high Dmax can be achieved with a small amount of silver. The grains have the feature that the developing activity is high because of their high specific surface area. The silver halide grains for use in the present invention preferably have an aspect ratio of from 4 to 100, particularly from 8 to 100.

The silver halide grains may have any mean grain size, ranging from fine grains having a mean grain size of 0.05 $\mu$m or less to large-sized grains having a diameter of a projected area exceeding 10 $\mu$m. The mean grain size is preferably 0.1 to 2 $\mu$m, and more preferably 0.1 to 0.9 $\mu$m.

Monodisperse emulsions having a narrow grain size distribution may be used. The monodisperse emulsions are, for example, silver halide emulsions having such a grain size distribution that 80% or more of the weight or number of the total grains fall within the range of ±30% of a mean grain size. Utilizing methods of the monodisperse emulsion grains are described in Trevor Maternaghan, *Surfactant Science Series* (*Technological Applications of Dispersions*), vol. 52, page 373 (1994).

The polydisperse emulsions having a wide grain size distribution may also be used.

Further, for adjusting gradation, two or more kinds of monodisperse silver halide emulsions may be used in combination which have a substantially identical color sensitivity and are different in grain size, as described in JP-A-1-167743 and JP-A-4-223463. The two or more kinds of emulsions may be added to the same layer or separately added to different layers. Combinations of two or more kinds of polydisperse silver halide emulsions or combinations of monodisperse emulsions and polydisperse emulsions can also be used.

In the course of preparation of the silver halide emulsions in the present invention, salt removal for removing excess salts is preferably conducted. Water washing with noodle may be used which is conducted by gelation of gelatin, and precipitation (flocculation) may also be used in which multiply charged anionic inorganic salts (for example, sodium sulfate), anionic surfactants, anionic polymers (for example, sodium polystyrenesulfonate) or gelatin derivatives (for example, aliphatic acylated gelatin, aromatic acylated gelatin and aromatic carbamoylated gelatin) are utilized. Ultrafilters shown in U.S. Pat. No. 4,758,505, JP-A-62-113137, JP-B-59-43727 and U.S. Pat. No. 4,334,012 may also be used, and spontaneous precipitation and centrifugation may also be used. Usually, precipitation is preferably used.

Preparation methods of the silver halide emulsions are described in P. Glafkides, *Chemie et Phisique Photographique* (Paul Montel, 1967), G. F. Duffin, *Photographic Emulsion Chemistry* (Focal Press, 1966) and V. L. Zelikman et al., *Making and Coating Photographic Emulsion* (Focal Press, 1964). The preparation methods may be any of acidic, neutral and ammonia processes. The pH may be heightened to such an extent that no fog occurs. A soluble silver salt and a soluble halogen salt may be reacted with each other by using any of a single jet process, a double jet process and a combination thereof. A so-called reverse mixing process in which grains are formed in the presence of excess silver ions can also be used. As a type of double jet process, a process for maintaining constant the pAg in a liquid phase in which a silver halide is formed, namely a so-called controlled double jet process, can also be used. According to this process, silver halide emulsions are obtained in which the crystal system is regular and the grain size is nearly uniform.

In the preparation of the silver halide emulsion, it is preferred to adjust the pAg and the pH during formation of the grains. Adjustment of the pAg and the pH are described in *Photographic science and Engineering*, 6, 159–165 (1962), *Journal of Photographic Science*, 12, 242–251 (1964), U.S. Pat. No. 3,655,394 and British Patent 1,413,748.

Gelatin is advantageously used as protective colloids for use in the preparation of the emulsion of the present invention, but other hydrophilic colloids can also be used. The hydrophilic colloids can be used alone or in combination with gelatin. Examples of the hydrophilic colloids which can be preferably used include proteins such as gelatin derivatives, graft polymers of gelatin with other polymers, albumin and casein; cellulose derivatives such as hydroxyethyl cellulose and cellulose sulfates; sodium alginate; starch derivatives; polysaccharides; carageenan; and synthetic hydrophilic polymers such as homopolymers and copolymers of polyvinyl alcohol, modified alkyl polyvinyl alcohols, poly-N-vinylpyrrolidone, polyacrylic acid, polymethacrylic acid, polyacrylamide, polyvinylimidazole and polyvinylpyrazole. Thioether polymers described in U.S. Pat. No. 3,615,624 can also be preferably used.

Gelatin derivatives such as acid-treated gelatin, delimed gelatin, phthalated gelatin and carbamoylated gelatin, and low molecular weight gelatin can be used as the gelatin, besides lime-treated gelatin. Gelatin oxidized with an oxidizing agent such as hydrogen peroxide and enzyme-treated gelatin as described in *Bull. Soc. Photo. Japan*, 16, 30 (1966) can also be used. Hydrolyzed or enzymatically decomposed products of gelatin can also be used.

Examples of a solvent for a silver halide, which is used for the preparation of the silver halide emulsion, include thiocyanates described in U.S. Pat. Nos. 2,222,264, 2,448,534 and 3,320,069, thioether compounds described in U.S. Pat. Nos. 3,271,157, 3,574,628, 3,704,130, 4,297,439 and 4,276,347, thione compounds described in JP-A-53-144319, JP-A-53-82408 and JP-A-55-77737, imidazole compounds described in JP-A-54-100717, benzimidazole compounds described in JP-B-60-54662 and amine compounds described in JP-A-54-100717. Ammonia can also be used in combination with the above described solvents for silver halides as long as it does not exert an adverse effect. Nitrogen-containing compounds as described in JP-B-46-7781, JP-A-60-222842 and JP-A-60-122935 can be added in the formation stage of the silver halide grains. Details of specific examples of the solvent for a silver halide, which is for use in the preparation of the silver halide emulsion, are described in JP-A-62-215272, pages 12 to 18.

In the course of preparation or physical ripening of the silver halide grains, metal salts (including complex salts) may be allowed to coexist. Examples of the metal salts include salts or complex salts of noble metals or heavy metals such as cadmium, zinc, lead, thallium, iridium, platinum, palladium, osmium, rhodium, chromium, ruthenium, rhenium, cobalt, gallium, copper, nickel, manganese, indium, tin, calcium, strontium, barium, aluminum and bismuth. These compounds may be used alone or in combination. The amount to be added is about $10^{-9}$ to $10^{-3}$ mol per mol of silver halide. These metals are preferably used as water-soluble salts such as ammonium salts, acetates, nitrates, sulfates, phosphates and hydroxides, or 6-coordinate complexes and 4-coordinate complexes. As for complex ions and coordination compounds, bromine ions, chlorine ions, cyanogen ions, nitrosyl ions, thionitrosyl ions, water, ammonia, oxo, carbonyl and combinations thereof are preferably used, and $K_2IrCl_6$, $K_3IrCl_6$, $(NH_4)_2RhCl_5(H_2O)$, $K_2RuCl_5(NO)$, $K_3Cr(CN)_6$, $K_4Ru(CN)_6$, $CdCl_2$ and $Pb(CH_3COO)_2$ are preferably used. The amount to be added is about $10^{-9}$ mol to about $10^{-2}$ mol per mol of silver halide, although it depends on the purpose of use. They may be uniformly incorporated into the silver halide grains, localized in the insides or on the surfaces of the grains, in the silver bromide-localized phases or in the high silver halide grain bases. These compounds are added by mixing solutions of the metal salts with aqueous solutions of halides or solutions of water-soluble silver salts in formation of the grains, and continuously adding the resulting mixtures during formation of the grains, or adding fine grains of the silver halide emulsion grains doped with the metal ions, or directly adding solutions of the metal salts before, during or after formation of the grains. During formation of the grains, the solutions of the metal salts may be continuously added.

When the metal salts are dissolved in water or appropriate solvents such as methanol and acetone, methods of adding aqueous solutions of hydrogen halides (for example, HCl and HBr), thiocyanic acid or salts thereof, or alkali halides (for example, KCl, NaCl, KBr and NaBr) can be used for stabilizing the solutions. Further, it is preferred from the viewpoint of stabilization of the solutions to add acids or alkalis as needed.

In order to increase the sensitivity and the density at high illumination exposure, complex metal salts having cyanogen ions such as iridium and yellow prussiate as ligands, lead chloride, cadmium chloride and zinc chloride can be preferably used. When spectral sensitization is conducted in the red or infrared region, complex metal salts having cyanogen ions such as yellow prussiate as ligands, lead chloride, cadmium chloride and zinc chloride are preferably used. For contrast enhancement, rhodium salts, ruthenium salts and chromium salts are preferably used.

In some cases, methods of adding chalcogenide compounds as described in U.S. Pat. No. 3,772,031 during formation of the emulsions are also useful. In addition of S, Se and Te, cyanates, thiocyanates, selenocyanates, carbonates, phosphates and acetates may be allowed to exist.

The rate of addition, the amount or the concentration of silver salt solutions (for example, an aqueous solution of $AgNO_3$) and halogen compound solutions (for example, an aqueous solution of KBr) to be added in the formation of the silver halide grains may be increased to accelerate the grain formation. Methods for thus rapidly forming the silver halide grains are described in British Patent 1,335,925, U.S. Pat. Nos. 3,672,900, 3,650,757 and 4,242,445, JP-A-55-

142329, JP-A-55-158124, JP-A-58-113927, JP-A-58-113928, JP-A-58-111934 and JP-A-58-111936.

Halogen may be substituted by halogen which forms slightly soluble silver halide grains on surfaces of the silver halide grains during or after formation of the grains (halogen conversion). This halogen conversion process is described in *Die Grundlagen der Photographischen Prozesse mit Silverhalogeniden*, pages 662 to 669, and *The theory of Photographic Process*, the fourth edition, pages 97 and 98. In this process, halogen may be added either in the form of a solution of a soluble halide or in the form of fine silver halide grains.

During and/or after formation of the grains, inorganic metal complexes such as thiosulfonates, dichalcogen compounds described in U.S. Pat. Nos. 5,219,721 and 5,364,754, lipoic acid, cysteine, elementary sulfur and cobalt-ammonium complex may be added.

In the present invention, the silver halide emulsion can be used without chemical sensitization, but the silver halide emulsion chemically sensitized are usually used. With respect to chemical sensitization for use in the present invention, chalcogen sensitizations such as sulfur sensitization, selenium sensitization and tellurium sensitization, noble metal sensitizations using gold, platinum and palladium, and reduction sensitization can be used alone or in combination (for example, JP-A-3-110555 and JP-A-5-241267). Such chemical sensitization can be conducted in the presence of nitrogen-containing heterocyclic compounds (JP-A-62-253159). Further, antifoggants described below can be added after termination of chemical sensitization. Specifically, methods described in JP-A-5-45833 and JP-A-62-40446 can be used.

Such chemical sensitization can be conducted at any time of the preparation stages of the silver halide emulsion. Various types of emulsions can be prepared depending on the stage at which the chemical sensitization is conducted. There are a type of embedding chemically sensitized nuclei in the insides of the grains, a type of embedding chemically sensitized nuclei at positions shallow from the surfaces of the grains, and a type of producing chemically sensitized nuclei on the surfaces of the grains. Various sensitized nuclei can be formed in the insides, on the surfaces or at positions shallow from the surfaces of the grains. For example, it is preferred that reduction-sensitized nuclei are formed in the insides of the grains and chalcogen-sensitized nuclei and/or gold chalcogen-sensitized nuclei are formed on the surfaces of the grains. However, various combinations are possible depending on the purpose thereof.

As for sulfur sensitizers, unstable sulfur compounds are used. Examples of the sulfur compounds include known sulfur compounds such as thiosulfates (for example, hypo), thiourea derivatives (for example, diphenylthiourea, triethylthiourea and allylthiourea), allyl isothiocyanate, cystine, p-toluenethiosulfonates, rhodanine derivatives and mercapto compounds. The sulfur sensitizers may be added in an amount sufficient to effectively enhancing the sensitivity of the emulsions, and preferably used within the range of $10^{-9}$ mol to $10^{-1}$ mol per mol of silver halide as a guide, although the suitable amount thereof varies in balance with the pH, the temperature and other sensitizers, and depending on various conditions such as the size of the silver halide grains.

In selenium sensitization, known unstable selenium compounds are used. Examples of the selenium compounds include colloidal metallic selenium, selenourea derivatives (for example, N,N-dimethylselenourea and N,N-diethylselenourea), selenoketones, selenoamides, aliphatic isoselenocyanates (for example, allyl isoselenocyanate), selenocarboxylic acids and esters thereof, selenophoshpates and selenides such as diethyl selenide and diethyl diselenide. The selenium sensitizers are preferably used within the range of $10^{-10}$ mol to $10^{-1}$ mol per mol of silver halide as a guide, although the amount varies depending on various conditions as is the case with the sulfur sensitizers.

In the present invention, noble metal sensitization can also be employed, in addition to chalcogen sensitization. First, in gold sensitization, the valence of gold may be either +1 or +3, and various kinds of gold compounds are used. Typical examples thereof include chloroaurates such as potassium chloroaurate, auric trichloride, potassium aurothiocyanate, potassium iodoaurate, tetraauric acid, ammonium aurothiocyanate, pyridyltrichlorogold, gold sulfide, gold selenide and gold telluride.

The gold sensitizers are preferably used within the range of $10^{-10}$ mol to $10^{-1}$ mol per mol of silver halide as a guide, although the amount varies depending on various conditions.

The gold sensitizers may be added simultaneously with sulfur sensitization, selenium sensitization or tellurium sensitization, or during, before or after sulfur sensitization, selenium sensitization or tellurium sensitization. It is also possible to use the gold sensitizers alone.

There is no particular limitation on the pAg and the pH of the emulsion which are subjected to sulfur sensitization, selenium sensitization, tellurium sensitization or gold sensitization in the present invention. However, the pAg is preferably from 5 to 11, more preferably from 6.8 to 9.0, and the pH is preferably from 3 to 10, more preferably from 5.5 to 8.5.

In the present invention, noble metals other than gold can also be used as chemical sensitizes. The noble metals other than gold include, for example, salts of metals such as platinum, palladium, iridium and rhodium, and complex salts thereof.

As the palladium compounds, salts of divalent palladium and salts of tetravalent palladium can be used. For example, $K_2PdCl_4$ and $Na_2PdCl_6$ are preferred.

Gold and noble metal compounds may be used in combination with thiocyanates or selenocyanates.

In the present invention, when noble metals such as rhodium and iridium and heavy metals are allowed to be contained in the insides of silver halide grains, application of chemical sensitization with gold chalcogens is preferred.

In the present invention, reduction sensitization can be further employed. The reduction sensitization is preferably conducted during formation of the grains, after formation of the grains and before or during chemical sensitization, or after chemical sensitization.

The reduction sensitization may be any method selected from: addition of reduction sensitizers to silver halide emulsions; silver ripening in which emulsion grains are allowed to grow or ripen in an atmosphere of a low pAg of 1 to 7; and high pH ripening in which emulsion grains are allowed to grow or ripen in an atmosphere of a high pH of 8 to 11. Further, two or more thereof can be used in combination.

As for the reduction sensitizer for use in the present invention, sulfites, ascorbic acid, stannous salts, amines, polyamines, hydrazine derivatives, formamidinesulfinic acids, silane compounds and borane compounds are known. In the present invention, one selected from these known compounds can be used, or two or more of them can also be used in combination. Preferred examples of the reduction sensitizer include stannous chloride, thiourea dioxide, dimethylamine borane, L-ascorbic acid and aminoiminomethanesulfinic acid. The alkynylamine compounds described in U.S. Pat. No. 5,389,510 are also effective compounds. The addition amount of the reduction sensitizer depends on emulsion conditions, and therefore must be appropriately selected. However, it is suitably within the range of $10^{-9}$ mol to $10^{-2}$ mol per mol of silver halide.

Besides addition of the above-described reduction sensitizer, reduction sensitization by passing a hydrogen gas or by use of nascent hydrogen produced by electrolysis can also be used.

These reduction sensitizations can be used alone, but can also be used in combination with the above-described chalcogen sensitization or noble metal sensitization.

The reduction sensitizers are dissolved in water or solvents such as alcohols, glycols, ketones, esters and amides, and the resulting solutions are added during and/or after formation of the grains. In case of adding during formation of the grains, they may be previously added in reaction vessels. However, it is preferred that they are added at an appropriate time of the grain formation. Further, the reduction sensitizers may be dissolved in aqueous solutions of halides or solutions of water-soluble silver salts, and the silver halide grains may be precipitated with the resulting solutions. Furthermore, solutions of the reduction sensitizers may be added several times in parts in accordance with growth of the grains, or preferably continously added for a long period of time.

There is no particular limitation on other additives added to the light-sensitive material using the emulsion for use in the present invention. For example, reference can be made to the descriptions of *RD*, vol. 176, item 17643 (RD-17643) ibid., vol. 187, item 18716 (RD-18716), ibid., vol. 307, item 307105 (RD-307105).

Additives for use in the above described stages and known photographic additives which can be used in the light-sensitive material and the processing sheet for use in the present invention are described in RD-17643, RD-18716 and RD-307105, at portions as shown below.

| Type of Additives | RD 17643 | RD 18716 | RD 307105 |
|---|---|---|---|
| 1. Chemical Sensitizer | p.23 | p.648, right column | p.866 |
| 2. Sensitivity Increasing Agent | | p.648, right column | |
| 3. Spectral Sensitizer, Supersensitizer | pp.23–24 | p.648, right column to p.649, right column | pp.866–868 |
| 4. Brightening Agent | p.24 | p.648, right column | p.868 |
| 5. Antifoggant, Stabilizer | pp.24–25 | p.649, right column | pp.868–870 |
| 6. Light Absorbent, Filter dye, Infra-red Absorbent | pp.25–26 | p.649, right column to p.650, left column | p.873 |
| 7. Stain Inhibitor | p.25, right column | p.650, left column to right column | |
| 8. Dye Image Stabilizer | p.25 | p.650, left column | p.872 |
| 9. Hardener | p.26 | p.651, left column | pp.874–875 |
| 10. Binder | p.26 | p.651, left column | pp.873–874 |
| 11. Plasticizer, Lubricant | p.27 | p.650, right column | p.876 |
| 12. Coating Aid, Surfactant | pp.26–27 | p.650, right column | pp.875–876 |
| 13. Antistatic Agent | p.27 | p.650, right column | pp.876–877 |
| 14. Matting Agent | | | pp.878–879 |

Of the above-described additives, preferred antifoggants and stabilizers include azaindene compounds (for example, triazaindenes, tetraazaindenes (particularly, 4-hydroxy-6-methyl(1,3,3a,7)tetraazaindenes) and pentaazaindenes), benzenethiosulfonic acid compounds, benzenesulfinic acid, benzenesulfonic acid amides, disulfides, thiosalicylic acid, thiazolium compounds, hydroquinone derivatives and mercapto compounds (for example, mercaptotetrazole and mercaptothiadiazole). In particular, thiazolium compounds, thiosalicylic acid, water-soluble hydroquinone, thiosulfonic acids and disulfides are preferably used.

In the present invention, the amount of the silver halide emulsion for use in the light-sensitive material is preferably 0. 5 g/m$^2$ to 2.5 g/m$^2$, more preferably 1.0 g/m$^2$ to 2.0 g/m$^2$, and most preferably 1.2 g/m$^2$ to 1.8 g/m$^2$, in terms of silver.

The heat developable light-sensitive material for use in the present invention basically have a light-sensitive silver halide, a hydrophilic binder, a reducing agent and a slightly water-soluble basic metal compound on a support, and can further contain an organic metal salt oxidizing agent and a dye donative compound, if necessary.

In many cases, these components are added to the same layer. However, they can also be separately added to different layers. The reducing agent is generally contained in the heat developable light-sensitive material. However, it may be supplied from the outside, for example, by diffusion from the processing sheet. Further, the silver halide emulsion light-sensitive layer may be divided into two or more layers as needed.

The light-sensitive material may be provided with various non-light-sensitive layers such as a protective layer, a subbing layer, an intermediate layer, a filter layer and an antihalation layer, between the above-described silver halide emulsion layers and as the uppermost and lowermost layers on the emulsion layer side of the support, and can be provided with various supplementary layers such as back layers on the opposite side of the support. Specifically, the light-sensitive material can be provided with subbing layers as described in U.S. Pat. No. 5,051,335, intermediate layers containing reducing agents or DIR compounds as described in JP-A-1-120553, JP-A-5-34884 and JP-A-2-64634, intermediate layers containing electron transfer agents as described in U.S. Pat. Nos. 5,017,454 and 5,139,919 and JP-A-2-235044, protective layers containing reducing agents as described in JP-A-4-249245, or combined layers thereof.

When the support is polyethylene-laminated paper containing a white pigment such as titanium oxide, it is preferred that the back layer is designed to have an antistatic function and a surface resistivity of $10^{12}$ Ω.cm or less.

As for the binders for the layers constituting the heat developable light-sensitive material and the processing sheet, hydrophilic binders are preferably used. Examples thereof include binders described in *RD* stated above and JP-A-64-13546, pages 71 to 75. Specifically, transparent or translucent hydrophilic binders are preferred, and examples thereof include natural compounds such as proteins (for example, gelatin and gelatin derivatives), polysaccharides (for example, cellulose derivatives, agar, starch, gum arabic, dextran, pullulan, furcellaran, the carageenan described in EP-A-443,529, low cast bean gum, xanthan gum and pectin) and polysaccharides described in JP-A-1-221736; and synthetic polymers such as polyvinyl alcohol, modified alkyl polyvinyl alcohols described in JP-A-7-219113, polyvinylpyrrolidone and polyacrylamide. Further, there can also be used high water-absorptive polymers described in U.S. Pat. No. 4,960,681 and JP-A-62-245260, namely homopolymers of vinyl monomers having —COOM or —$SO_3$M (wherein M represents a hydrogen atom or an alkali metal), or copolymers of these vinyl monomers with each other or with other monomers (for example, sodium methacrylate, ammonium methacrylate and Sumikagel L-5H manufactured by Sumitomo Chemical Co, Ltd.). These binders can also be used in combination. Combinations of gelatin and the above-described binders are preferred. Gelatin is selected from lime-treated gelatin, acid-treated gelatin and so-called delimed gelatin reduced in content of calcium, which are preferably used in combination.

When the system of supplying a trace amount of water to conduct heat development is employed, use of the above-described high water-absorptive polymers makes it possible to rapidly absorb water.

Gelatin is preferably used as the binder. When the gelatin content is low, however, carageenan described in EP-A-443529, the modified alkyl polyvinyl alcohols described in JP-A-7-219113 and polysaccharides described in JP-A-6-67330 are preferably used as the hydrophilic polymers other than gelatin in terms of the setting property in coating.

The total coating amount of binders on the side containing the light-sensitive silver halide emulsion layer of the light-sensitive material is preferably 12 g/m$^2$ or less, more preferably 5 g/m$^2$ or less, and most preferably 4 g/m$^2$ or less. On the other hand, the total coating amount of binders on the side opposite to the side containing the light-sensitive silver halide emulsion layer is preferably within the range of 50% to 100%, and more preferably about 70%, of the total coating amount of binders on the light-sensitive silver halide emulsion layer side.

The reducing agent for use in the present invention may be those known in the field of heat developable light-sensitive materials. Further, the reducing agent also include reductive dye-donating compounds described below (in this case, they can also be used in combination with other reducing agents). Furthermore, precursors of reducing agents can also be used which themselves have no reductive ability, but exhibit reductive ability by the action of nucleophilic reagents or heat during the course of development.

Examples of the reducing agent for use in the present invention include reducing agents and precursors thereof described in U.S. Pat. Nos. 4,500,626, columns 49 and 50, 4,839,272, 4,330,617, 4,590,152, 5,017,454 and 5,139,919, JP-A-60-140335, pages 17 and 18, JP-A-57-40245, JP-A-56-138736, JP-A-59-178458, JP-A-59-53831, JP-A-59-182449, JP-A-59-182450, JP-A-60-119555, JP-A-60-128436, JP-A-60-128439, JP-A-60-198540, JP-A-60-181742, JP-A-61-259253, JP-A-62-201434, JP-A-62-244044, JP-A-62-131253, JP-A-62-131256, JP-A-63-10151, JP-A-64-13546, pages 40 to 57, JP-A-1-120553, JP-A-2-32338, JP-A-2-35451, JP-A-2-234158, JP-A-3-160443 and EP-A-220,746, pages 78 to 96.

The combinations of various reducing agents as disclosed in U.S. Pat. No. 3,039,869 can also be used.

When nondiffusible reducing agents are used as the reducing agent for use in the present invention, electron transfer agents and/or precursors thereof can be used in combination to enhance electron transfer between the nondiffusible reducing agents and the silver halides as needed. It is particularly preferred to use those described in U.S. Pat. No. 5,139,919 given above, EP-A-418,743, JP-A-1-138556 and JP-A-3-102345. Further, methods for stably introducing them into layers as described in JP-A-2-230143 and JP-A-2-235044 are preferably used.

The electron transfer agents or the precursors thereof can be selected from the reducing agents or the precursors thereof described above. It is desirable that the electron transfer agents or the precursors thereof be higher in their mobility than the nondiffusible reducing agents (electron donors). Particularly useful electron transfer agents are 1-phenyl-3-pyrazolidone compounds and aminophenol compounds.

The nondiffusible reducing agents (electron donors) for use in combination with the electron transfer agents may be any of the above-described reducing agents as long as they do not substantially move in the layers of the light-sensitive material. Preferred examples thereof include hydroquinone compounds, sulfonamidophenols, sulfonamidonaphthols, compounds described in JP-A-53-110827, U.S. Pat. Nos. 5,032,487, 5,026,634 and 4,839,272 as electron donors, and nondiffusible reductive dye-donating compounds described below.

Further, precursors of electron donors as described in JP-A-3-160443 are also preferably used.

Furthermore, for various purposes such as color mixture prevention, improvement in color reproduction, improvement in white backgrounds and prevention of silver transfer to dye fixing materials, the above-described reducing agents can be used in intermediate layers or protective layers. Specifically, reducing agents described in EP-A-524,649, EP-A-357,040, JP-A-4-249245, JP-A-2-64633, JP-A-2-46450 and JP-A-63-186240 are preferably used. Further, reductive compounds which release development inhibitors as described in JP-B-3-63733, JP-A-1-150135, JP-A-2-110557, JP-A-2-64634, JP-A-3-43735 and EP-A-451,833 are also used.

In the present invention, the total addition amount of the reducing agents is preferably 0.01 mol to 20 mol, and more preferably 0.1 mol to 10 mol, per mol of silver.

In a preferred embodiment of the present invention, a 1-phenyl-3-pyrazolidone compounds and a 5-pyrazolidone compound are used in combination as the reducing agent (developing agent). This can prevent powdering trouble caused by reducing agents and enhance the storability.

The 1-phenyl-3-pyrazolidone compound for use in the preferred embodiment as the reducing agent (developing agent) include those represented by general formula (I):

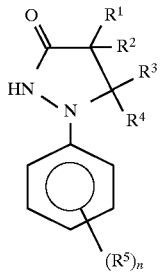

(I)

In general formula (I), $R^1$ to $R^4$ each represents a hydrogen atom or a substituent group. Examples of the substituent groups represented by $R^1$ to $R^4$ include alkyl groups (having from 1 to 60 carbon atoms, for example, methyl, ethyl, propyl, iso-butyl, t-butyl, 2-ethylhexyl, nonyl, undecyl, pentadecyl, n-hexadecyl, hydroxymethyl and hydroxyethyl), aryl groups (having from 1 to 30 carbon atoms, for example, phenyl, naphthyl and p-methoxyphenyl), acylamino groups (having from 2 to 60 carbon atoms, for example, acetylamino, n-butanoylamino, octanoylamino, 2-hexadecanoyl-amino, 2-(2',4'-di-t-amyl-phenoxy) butanoylamino, benzoylamino and nicotinoylamino), alkoxy groups (having from 1 to 60 carbon atoms, for example, methoxy, ethoxy, butoxy, n-octyloxy, hexadecyloxy and 2-methoxyethoxy), aryloxy groups (having from 6 to 60 carbon atoms, for example, phenoxy, 2,4-t-amylphenoxy, 4-t-butylphenoxy and naphthoxy), alkylthio groups (having from 1 to 60 carbon atoms, for example, methylthio, ethylthio, butylthio and hexadecylthio), arylthio groups (having from 6 to 60 carbon atoms, for example, phenylthio and 4-dodecyloxyphenylthio), acyl groups (having from 1 to 60 carbon atoms, for example, acetyl, benzoyl, butanoyl and dodecanoyl), sulfonyl groups (having from 1 to 60 carbon atoms, for example, methanesulfonyl, butanesulfonyl and toluenesulfonyl), sulfonylamino groups (having from 1 to 60 carbon atoms, for example, methanesulfonylamino and phenylsulfonylamino), a cyano group, carbamoyl groups (having from 1 to 60 carbon atoms, for example, N,N-dicyclohexycarbamoyl), sulfamoyl groups (having from 0 to 60 carbon atoms, for example, N,N-dimethylsulfamoyl), a sulfo group (including salts thereof), a carboxyl group (including salts thereof), halogen atoms (for example, chlorine, bromine and fluorine), an amino group, alkoxycarbonyl groups (for example, ethoxycarbonyl), heterocyclic groups (for example, 2-pyridyl) and a hydroxyl group.

These substituent groups may be further substituted by these substituent groups, and may combine with each other to form a ring, if possible.

Examples of the substituent group represented by $R^5$ include the substituent groups given for $R^1$ to $R^4$, and n represents an integer of 0 to 5. When n is 2 or more, two or more $R^5$'s may be the same or different.

$R^1$ to $R^4$ are each preferably a hydrogen atom, an alkyl group or an aryl group. Preferred example of the alkyl group include methyl and hydroxymethyl, and preferred examples of the aryl group include phenyl.

$R^5$ is preferably a hydrogen atom, a halogen atom (for example, chlorine or bromine), an alkyl group (an alkyl group having 1 to 10 carbon atoms, for example, methyl, ethyl, t-butyl or 2-ethylhexyl) or an alkoxy group (an alkoxy group having 1 to 10 carbon atoms, for example, methoxy, iso-propoxy or 2-ethylhexyloxy) are preferred. n is preferably 0 or 1.

Specific examples of useful 1-phenyl-3-pyrazolidone compounds for us in the invention are shown below.

(I-1)

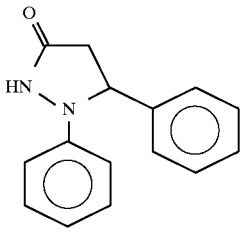

(I-2)

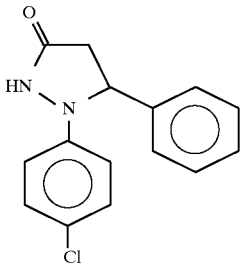

-continued (I-3)

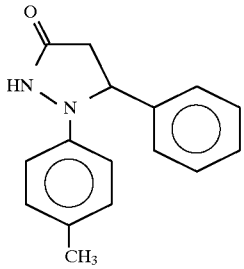

(I-4)

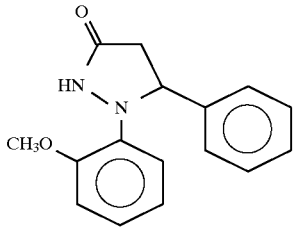

(I-5)

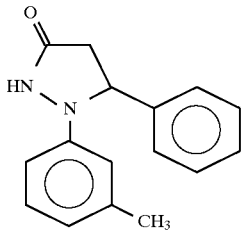

(I-6)

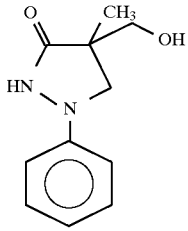

(I-7)

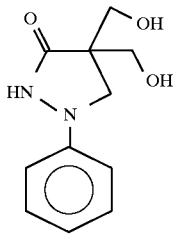

(I-8)

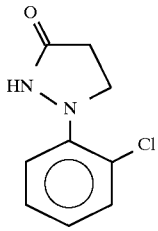

-continued (I-9)

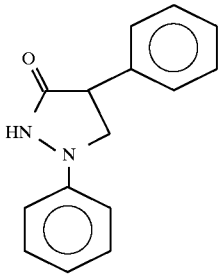

(I-10)

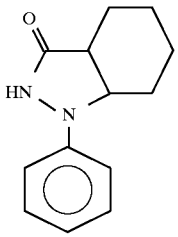

The 5-pyrazolidone compound for used in the preferred embodiment of the present invention include those represented by general formula (II):

(II)

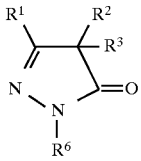

In general formula (II), $R^1$ to $R^3$ each represents a hydrogen atom or the same substituent group as each given for $R^1$ to $R^4$ of the above-described general formula (I), and $R^6$ represents a substituted or unsubstituted phenyl or alkyl group. When $R^6$ is a substituted phenyl or alkyl group, examples of the substituent group thereof include those given for $R^1$ to $R^3$.

$R^6$ is preferably a substituted or unsubstituted phenyl group, and $R^1$ to $R^3$ are each preferably an alkyl group (particularly methyl or ethyl), a substituted or unsubstituted phenyl group or a hydrogen atom.

Specific examples of useful 5-pyrazolidone compound for use in the present invention are shown below, but the present invention should not be construed as being limited thereto.

(II-1)

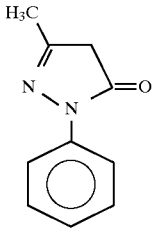

-continued (II-2)

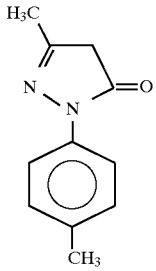

(II-3)

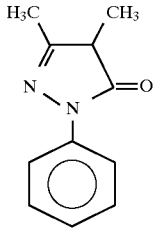

(II-4)

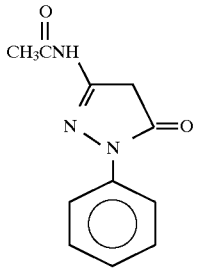

(II-5)

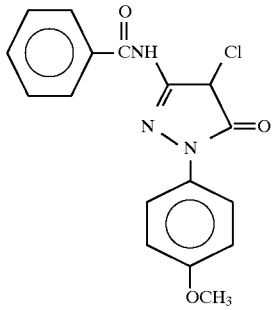

(II-6)

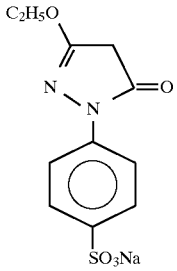

-continued (II-7)

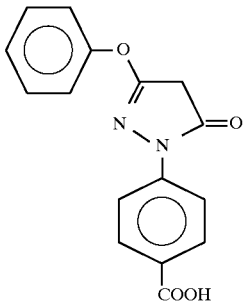

(II-8)

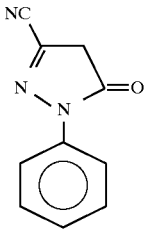

(II-9)

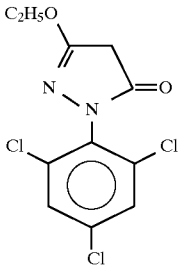

(II-10)

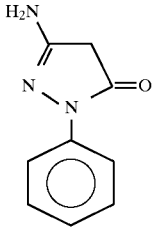

(II-11)

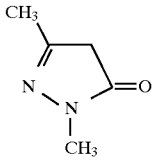

(II-12)

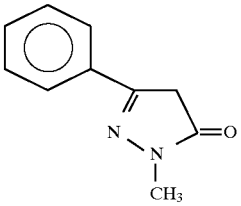

-continued (II-13)

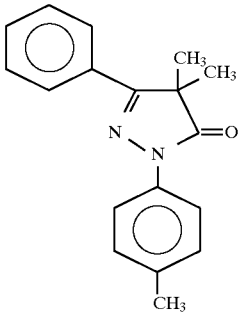

(II-14)

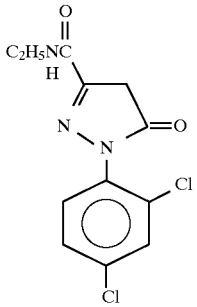

In this preferred embodiment of the present invention, powdering developed during storage of images and an increase in haze can be inhibited by the use of the 5-pyrazolidone compound in combination with the 1-phenyl-3-pyrazolidone compound. The use amount of the 1-phenyl-3-pyrazolidone compound in the light-sensitive material is 0.1 to 1.0, and preferably 0.3 to 0.6, in terms of molar ratio to the silver halides. Further, the use amount of the 5-pyrazolidone compound in the light-sensitive material is 0.02 to 0.5, and preferably 0.05 to 0.3, in terms of molar ratio to the 1-phenyl-3-pyrazolidone compound.

Although only the 1-phenyl-3-pyrazolidone compound (including a combination of a plurality of the derivatives) may be used as the reducing agent, the following compounds which are known in the field of light-sensitive materials can also be used in combination. Further, precursors of reducing agents can also be used which themselves have no reductive ability, but exhibit reductive ability by the action of nucleophilic reagents or heat during the course of development.

Examples of the reducing agents for use in the present invention include reducing agents and precursors of reducing agents described in U.S. Pat. Nos. 4,500,626, columns 49 and 50, 4,839,272, 4,330,617, 4,590,152, 5,017,454 and 5,139,919, JP-A-60-140335, pages 17 and 18, JP-A-57-40245, JP-A-56-138736, JP-A-59-178458, JP-A-59-53831, JP-A-59- 182449, JP-A-59-182450, JP-A-60-119555, JP-A-60-128436, JP-A-60-128439, JP-A-60-198540, JP-A-60-181742, JP-A-61-259253, JP-A-62-201434, JP-A-62-244044, JP-A-62-131253, JP-A-62-131256, JP-A-63-10151, JP-A-64-13546, pages 40 to 57, JP-A-1-120553, JP-A-2-32338, JP-A-2-35451, JP-A-2-234158, JP-A-3-160443 and EP-A-220,746, pages 78 to 96.

In the present invention, use of dihydroxybenzene compound in combination with the 1-phenyl-3-pyrazolidone compound as the reducing agents is preferred for plate making light-sensitive materials, because it make possible to provide images having a high contrast, a high density and less fog. Of dihydroxybenzene compounds, catechol derivatives are particularly preferred. The use amount of the dihydroxybenzene compound is 0.02 to 1.0, and preferably 0.05 to 0.4, in terms of molar ratio to the 1-phenyl-3-pyrazolidone compound.

The 1-phenyl-3-pyrazolidone compounds, the above-described reducing agents and the 5-pyrazolidone compounds can each be added to any layers constituting the light-sensitive material such as a light-sensitive layer (emulsion layer), an antihalation layers, an intermediate layers and a protective layer. Further, they may be added in parts to a plurality of layers. It is desirable in view of production stability that the 1-phenyl-3-pyrazolidone compounds or the reducing agents having a high solubility with respect to water are added to layers other than the silver emulsion layers.

The 1-phenyl-3-pyrazolidone compounds, the above-described reducing agents and the 5-pyrazolidone compounds can be added in the form of solutions in organic solvents such as methanol, ethanol and DMF, in the form of known emulsified dispersions (for example, methods described in U.S. Pat. No. 2,322,027), or in the form of fine solid particle dispersions (for example, methods described in JP-A-62-30242).

In the present invention, organic metal salts can also be used as oxidizing agents in combination with the light-sensitive silver halide emulsion. Of organic metal salts, organic silver salts are particularly preferably used.

Organic compounds which can be used for forming the above-described organic silver salt oxidizing agents include the benzotriazole compounds, fatty acids and other compounds described in U.S. Pat. No. 4,500,626, columns 52 and 53. The silver acetylide described in U.S. Pat. No. 4,775,613 is also useful. Two of more kinds of the organic silver salts may be used in combination.

The above described organic metal salts can be used in combination with the light-sensitive silver halides in an amount of 0.01 mol to 10 mol, preferably 0.01 mol to 1 mol, per mol of the light-sensitive silver halide. The total coating amount of the light-sensitive silver halides and the organic metal salts is generally 0.05 g/m$^2$ to 10 g/m$^2$, and preferably 4 g/m$^2$, in terms of silver.

For preventing halation or irradiation, various dyes can be used in the layers constituting the light-sensitive material for use in the present invention. The dyes are preferably dispersed as fine solid particles to incorporate them into the light-sensitive material, as disclosed in JP-A-3-7931 and JP-A-2-308242. Specifically, compounds described in the above described *RD*, the compounds described in JP-A-8-101487, combinations of leuco dyes and developers, and dye mordant compositions can be preferably used.

In the heat developable light-sensitive material for use in the present invention, compounds for activating development and also stabilizing images can be used. Preferred examples of such compounds are described in U.S. Pat. No. 4,500,626, columns 51 and 52.

In the present invention, main image forming substances are developed silver in the light-sensitive material. Dyes (or dye-donating compounds) may be used as image forming substances as needed. In a light-sensitive material for printing plate making used as a printing original to a PS plate, the PS plate has the spectral sensitivity within the wavelength region from 300 nm to 500 nm so as to be treatable in an illuminated room with ultraviolet rays cut, and therefore a dye (dye-donating compound) having the absorption within this wavelength region can be converted to an image together with a silver image, as long as the image has the discrimination within this wavelength region. Further, it is also possible to provide a black-and-white image of dyes together with silver, by using at least two kinds of dye-donating compounds which form or release dyes substantially different in color tone from each other, or a dye-donating compound which forms or releases at least two kinds of dyes substantially different in color tone from each other.

Examples of the dye-donating compounds which can be used in the present invention include, for example, compounds which form dyes by oxidation coupling reaction (couplers). The couplers may be either 4-equivalent couplers or 2-equivalent couplers. Further, 2-equivalent couplers which has a nondiffusible group as a releasing group and forms a diffusible dye by oxidation coupling reaction are also preferred. The nondiffusible group may have a polymer chain in its structure. Examples of color developing agents and the couplers include the p-phenylenediamine reducing agents and the phenolic or active methylene couplers described in U.S. Pat. No. 3,531,286, the p-aminophenol reducing agents described in U.S. Pat. No. 3,761,270, the sulfonamidophenol reducing agents described in Belgian Patent 802,519 and *RD*, page 32, Sep. 31, 1975, and the combinations of sulfonamidophenol reducing agents and 4-equivalent couplers described in U.S. Pat. No. 4,021,240. Other examples of the color developing agents and the couplers are also described in T. H. James, *The Theory of the Photographic Process*, the fourth edition, pages 291 to 334 and 354 to 361. As for the reducing agents reactable with the couplers in the coupling reaction, hydrazone compounds and hydrazine compounds can also be preferably used.

As for other examples of the dye-donating compound, nondiffusible dye-donating compounds (thiazolidine compounds) having a heterocyclic ring containing a nitrogen atom and a sulfur or selenium atom, in which the heterocyclic ring is cleaved in the presence of silver ion or a soluble silver complex to release a mobile dye as described in JP-A-59-180548, can also be used.

Examples of the dye-donating compound further include compounds having the function of releasing or diffusing a diffusible dye imagewise. The compounds of this type can be represented by the following general formula (LI):

$$((\mathrm{Dye})_m\text{—}\mathrm{Y})_n\text{—}\mathrm{Z} \qquad \text{(LI)}$$

wherein Dye represents a dye group, a dye group temporarily shifted to a short wavelength, or a dye precursor group; Y represents only a bond or a bonding group; Z represents a group having the property of bringing about the difference in diffusibility of the compound represented by $((\mathrm{Dye})_m\text{—}\mathrm{Y})_n\text{—}\mathrm{Z}$ corresponding to or reversely corresponding to a light-sensitive silver salt having a latent image imagewise, or releasing $(\mathrm{Dye})_m\text{—}\mathrm{Y}$ to produce the difference in diffusibility between the released $(\mathrm{Dye})_m\text{—}\mathrm{Y}$ and $((\mathrm{Dye})_m\text{—}\mathrm{Y})_n\text{—}\mathrm{Z}$; m represents an integer of 1 to 5; n represents 1 or 2; and when m or n is not 1, the plurality of Dye's may be the same or different.

Specific examples of the dye-donating compounds represented by general formula (LI) include the following compounds (1) to (3) which form diffusive dye images in counter correspondence to the development of silver halides.

(1) The dye developing agents described in U.S. Pat. Nos. 3,134,764, 3,362,819, 3,597,200, 3,544,545 and 3,482,972 and JP-B-3-68387, in each of which a hydroquinone developing agent and a dye component are connected to each other. These dye developing agents are diffusible under alkaline conditions, but react with silver halides to become nondiffusible.

(2) As described in U.S. Pat. No. 4,503,137, nondiffusible compounds can also be used which release diffusible dyes under alkaline conditions, but react with silver halides to lose their capability. Examples thereof include the compounds which release diffusible dyes by the intermolecular nucleophilic substitution reaction as described in U.S. Pat. No. 3,980,479, and the compounds which release diffusible dyes by the intermolecular rearrangement reaction of isooxazolone rings as described in U.S. Pat. No. 4,199,354.

(3) As described in U.S. Pat. No. 4,559,290, EP-A-220,746, U.S. Pat. No. 4,783,396, JIII Journal of Technical Disclosure 87-6199 and JP-A-64-13546, nondiffusible compounds can also be used which react with reducing agents left unoxidized on development to release diffusible dyes.

Examples thereof include the compounds which release diffusible dyes by the intermolecular nucleophilic substitution reaction after reduction as described in U.S. Pat. Nos. 4,139,389 and 4,139,379, JP-A-59-185333 and JP-A-57-84453, the compounds which release diffusible dyes by the intermolecular electron migration reaction after reduction as described in U.S. Pat. No. 4,232,107, JP-A-59-101649, JP-A-61-88257 and *RD* 24025 (1984), the compounds which release diffusible dyes by cleavage of single bonds after reduction as described in West German Patent 3,008,588A, JP-A-56-142530, U.S. Pat. Nos. 4,343,893 and 4,619,884, the nitro compounds which release diffusible dyes after electron acceptance as described in U.S. Pat. No. 4,450,223, and the compounds which release diffusible dyes after electron acceptance as described in U.S. Pat. No. 4,609,610.

Preferred examples thereof include the compounds each having an N-X bond (wherein X represents an oxygen atom, a sulfur atom or a nitrogen atom) and an electron attractive group in one molecule as described in EP-A-220,746, JIII Journal of Technical Disclosure 87-6199, U.S. Pat. No. 4,783,396, JP-A-63-201653, JP-A-63-201654 and JP-A-64-13546, the compounds each having an $SO_2$—X (wherein X has the same meaning as given above) and an electron attractive group in one molecule as described in JP-A-1-26842, the compounds each having a PO—X bond (wherein X has the same meaning as given above) and an electron attractive group in one molecule as described in JP-A-63-271344, and the compounds each having a C—X' bond (wherein X' has the same meaning as with X, or represents —$SO_2$—) and an electron attractive group in one molecule as described in JP-A-63-271341. Further, the compounds described in JP-A-1-161237 and JP-A-1-161342 can also be utilized in each of which a single bond is cleaved by a $\pi$ bond conjugated with an electron acceptable group after reduction to release a diffusible dye.

Of these, the compounds each having an N-X bond and an electron attractive group in one molecule are particularly preferred.

Colored dye-donating compounds are allowed to exist in lower layers than the light-sensitive silver halide emulsion layer, whereby the sensitivity can be prevented from being lowered.

The hydrophobic additives such as the dye-donating compounds and the nondiffusible reducing agents can be introduced into the layers of the heat development light-sensitive material by known methods such as the methods described in U.S. Pat. No. 2,322,027. In this case, high boiling organic solvents as described in U.S. Pat. Nos. 4,555,470, 4,536,466, 4,536,467, 4,587,206, 4,555,476 and 4,599,296, JP-A-63-306439, JP-A-62-8145, JP-A-62-30247 and JP-B-3-62256 can be used in combination with low boiling organic solvents having a boiling point of 50° C. to 160° C. as needed. Further, these dye-donating compounds, nondiffusible reducing agents and high boiling organic solvents can be used in combination.

The use amount of the high boiling organic solvents is 10 g or less, preferably 5 g or less, and more preferably 1 g to 0.1 g, per gram of the hydrophobic additive to be used. Further, the use amount is 1 ml or less, preferably 0.5 ml or less, and more preferably 0.3 ml or less, per gram of binder.

Furthermore, the dispersing methods according to polymerized products described in JP-B-51-39853 and JP-A-51-59943 and the addition method in the form of dispersed fine particles described in JP-A-62-30242 can also be used.

Compounds substantially insoluble in water can be incorporated in binders by dispersing them in binders as fine particles, in addition to the above-described methods.

When the hydrophobic compounds are dispersed in hydrophilic colloids, various surfactants can be used. For example, the surfactants described in JP-A-59-157636, pages 37 and 38 and the above described *RD* can be used.

Further, the phosphate surfactants described in JP-A-7-56267, JP-A-7-228589 and West German Patent Publication (OLS) 1,932,299A can also be used.

When dye images are used in combination in the processing sheet, mordants known in the field of photography can be used. Examples thereof include the mordants described in U.S. Pat. No. 4,500,626, columns 58 and 59, JP-A-61-88256 pages 32 to 41, and JP-A-1-161236, pages 4 to 7, and the mordants described in U.S. Pat. Nos. 4,774,162, 4,619,883 and 4,594,308. Further, the dye acceptable polymers described in U.S. Pat. No. 4,463,079 may also be used.

The processing sheet may be provided with supplementary layers such as protective layers, separation layers, subbing layers, intermediate layers, back layers and curl prevention layers. In particular, it is useful to provide protective layers.

A binder for use in the processing sheet of the present invention are preferably the hydrophilic binders described above. Further, it is desirable to use the carageenan and polysaccharides such as dextran, as described in EP-A-443,529, and the latexes having a glass transition temperature of 40° C. or less as described in JP-B-3-74820, in combination with the above-described binders. Furthermore, mordant polymers known in the field of photography or the high water-absorptive polymers described in U.S. Pat. No. 4,960,681 and JP-A-62-245260 are preferably used in combination. Polymers such as vinylpyrrolidone, polyvinylimidazole and copolymers of pyrrolidone and imidazole can also be preferably used.

The total coating amount of the binders is preferably 20 g $m^2$ or less, more preferably 10 g/$m^2$ or less, and most preferably 7 g/$m^2$ or less.

In the layers constituting the heat developable light-sensitive material and the processing sheet, high boiling organic solvents can be used as plasticizers, slipping agents or separation improvers of the processing sheet from the light-sensitive material. Specific examples thereof include those described in the above described *RD* and JP-A-62-245253.

Further, for the above-described purposes, various silicone oils (all silicone oils including dimethylsilicone oils and modified silicone oils in which various organic groups are introduced into dimethylsiloxanes) can be used.

Effective examples thereof include the various modified silicone oils described in *Modified Silicone Oils*, Technical Data P6-18B, published by Shinetsu Silicone Co., Ltd., particularly carboxy-modified silicone (trade name: X-22-3710).

Further, the silicone oils described in JP-A-62-215953 and JP-A-63-46449 are also effective.

Hardeners for use in the layers constituting the heat developable light-sensitive material and the processing sheet include the hardeners described in the above described *RD*, U.S. Pat. Nos. 4,678,739, column 41, and 4,791,042, JP-A-59-116655, JP-A-62-245261, JP-A-61-18942 and JP-A-4-218044. More specifically, examples thereof include aldehyde hardeners (such as formaldehyde), aziridine hardeners, epoxy hardeners, vinylsulfone hardeners (such as N,N'-ethylenebis(vinyl-sulfonylacetamido)ethane), N-methylol hardeners (dimethylol-urea) and polymer hardeners (the compounds described in JP-A-62-234157).

These hardeners are generally used in an amount of 0.001 g to 1 g, preferably 0.005 g to 0.5 g, per gram of the hydrophilic binder coated. They may be added to any of the layers constituting the light-sensitive material and the processing sheet, and may be divided to add them to two or more layers.

In the layers constituting the heat developable light-sensitive material and the processing sheet, various antifoggants or photographic stabilizers and precursors thereof can be used. Examples thereof include the compounds described in the above described *RD*, U.S. Pat. Nos. 5,089,378, 4,500,627 and 4,614,702, JP-A-64-13546, pages 7 to 9, 57 to 71 and 81 to 97, U.S. Pat. Nos. 4,775,610, 4,626,500 and 4,983,494, JP-A-62-174747, JP-A-62-239148, JP-A-63-264747, JP-A-1-150135, JP-A-2-110557, JP-A-2-178650, *RD* 17643 (1978), pages 24 and 25, and JP-A-8-54705.

These compounds are preferably used in an amount of $5\times10^{-6}$ mol to $1\times10^{-1}$ mol, more preferably $1\times10^{-5}$ mol to $1\times10^{-2}$ mol, per mol of silver.

In the layers constituting the heat developable light-sensitive material and the processing sheet, various surfactants can be used for assisting coating, improving separation, improving slipperiness, preventing electric charge and accelerating development. Examples of the surfactants are described in the above described *RD*, JP-A-62-173463 and JP-A-62-183457.

The layers constituting the heat developable light-sensitive material and the processing sheet may contain organic fluoro compounds for improving slipperiness, preventing electric charge and improving separation. Typical examples of the organic fluoro compounds include the fluorine surfactants described in JP-B-57-9053, columns 8 to 17, JP-A-61-20944 and JP-A-62-135826, and hydrophobic fluorine compounds such as oily fluorine compounds (for example, fluorine oils) and solid fluorine compounds (for example, ethylene tetrafluoride resins).

The heat developable light-sensitive material can contain matting agents for preventing adhesion, improving slipperiness and delustering surfaces of the light-sensitive material. Various inorganic compounds and organic compound particles, particularly polymer particles, can be used as the matting agents. The inorganic matting agents include oxides such as silicon dioxide, colloidal silica, titanium oxide and aluminum oxide; alkaline earth metal salts such as barium sulfate, calcium carbonate and magnesium sulfate; and glass particles such as silicates, phosphates and borates. The organic matting agents include compounds such as benzoguanamine resin beads, polycarbonate resin beads and AS resin beads described in JP-A-63-274944; and compounds described in the above described *RD*, as well as natural compounds such as cornstarch, cellulose esters and cellulose ethers, and modified products thereof; synthetic resins such as alkyl acrylates, alkyl methacrylates, acrylamides, vinyl esters and styrene compounds; and compounds described in JP-A-61-88256, page 29, such as polyolefins and polymethacrylates. These matting agents can be added not only to the uppermost layer (protective layer), but also to lower layers as needed.

In the heat developable light-sensitive material for use in the present invention, the matting agent may be used either alone or as a combination of two or more thereof. The mean particle size of the matting agent for use herein is preferably 0.1 $\mu$m to 20 $\mu$m. The matting agent is preferably added in an amount of 1% to 40%, more preferably 2% to 20%, by weight ratio to the binder.

As described in JP-A-3-109542, JP-A-64-31149 and JP-A-62-163047, matting agents having voids or porous surfaces may also be used.

Besides, the layers constituting the heat developable light-sensitive material and the processing sheet may contain heat solvents, antifoaming agents and microbicidal antifungal agents. Examples of these additives are described in JP-A-61-88256, pages 26 to 32, JP-A-3-11338 and JP-B-2-51496.

In the present invention, image formation accelerating agents can be used in the heat developable light-sensitive material and/or the processing sheet. The image formation accelerating agents can be classified, according to the physicochemical functions, into bases or the above described base precursors, nucleophilic compounds, high boiling organic solvents (oils), heat solvents, surfactants, compounds having interaction with silver or silver ions. However, these groups of substances generally have combined functions, and therefore, they have usually combinations of some of the above-described accelerating effects. The details thereof are described in U.S. Pat. No. 4,678,739, columns 38 to 40.

In the present inventior, various development stoppers can be used in the heat developable light-sensitive material and/or the processing sheet for stably obtaining constant images against fluctuations in processing temperature and processing time on development.

The development stopper as used herein is a compound which, after normal development, rapidly neutralizes or reacts with a base to reduce the concentration of the base contained in a film, thereby stopping development, or a compound which interacts with silver and a silver salt to inhibit development. Examples thereof include acid precursors which release acids by heating, electrophilic compounds which conduct the substitution reaction with coexisting bases by heating, nitrogen-containing heterocyclic compounds, mercapto compounds and precursors thereof. More specifically, they are described in JP-A-62-253159, pages 31 and 32.

In the present invention, supports which can endure processing temperatures are used as supports for the heat developable light-sensitive material and the processing sheet. In general, the supports include the photographic supports such as paper and synthetic polymers (films) described in *Shashin Kohqaku no Kiso* (*Ginen Shashin*) (The Fundamentals of Photographic Engineering (Silver Photograph)), pages 223 to 240, edited by Nippon Shashin Gakkai, Corona Publishing Co. Ltd. (1979). Specific examples thereof include polyethylene terephthalate, polyethylene naphthalate, polycarbonates, polyvinyl chloride, polystyrene, polypropylene, polyimides, polyarylates, cellulose derivatives (for example, cellulose triacetate), these films which contain pigments such as titanium oxide, synthetic paper produced from propylene by film methods, mixed paper produced from pulp of synthetic resins such as polyethylene and natural pulp, Yankee paper, baryta paper, coated paper (particularly, cast-coated paper), metals, cloth and glass. The thickness of the supports is preferably 10 $\mu$m to 200 $\mu$m.

These supports can be used either alone or as supports coated with synthetic polymers such as polyethylene on one side or both sides thereof. The laminated layers can contain pigments such as titanium oxide, ultramarine and carbon black or dyes if necessary.

In addition, the supports described in JP-A-62-253159, pages 29 to 31, JP-A-1-161236, pages 14 to 17, JP-A-63-316848, JP-A-2-22651, JP-A-3-56955 and U.S. Pat. No. 5,001,033 can be used.

Back surfaces of these supports may be coated with hydrophilic binders and semiconductive metal oxides such as alumina sols and tin oxide, or with antistatic agents such as carbon black. Specifically, the supports described in JP-A-63-220246 can be used.

It is preferred in respect to improvement in adhesive quality after processing that back surface of the support for the light-sensitive material is coated with a water-resistant polymer.

It is desirable to design so as to give a surface resistivity of $10^{12}$ Ω.cm or less.

For improving adhesion to the hydrophilic binders, various surface treatments or undercoating treatments are preferably applied to the surfaces of the supports.

The light-sensitive material of the present invention can be utilized for various applications of printing light-sensitive materials, namely not only scanner films, but also films for halftone photography, films for line originals, contact (negative-positive type) films, contact (reversal positive-positive type) films, daylight films, micro light-sensitive materials, X-ray microfilms, computer output microfilms (COMs), computerized photo type setting light-sensitive materials, medical laser imager light-sensitive materials, double-sided or single-sided X-ray light-sensitive materials, negative or reversal light-sensitive materials for black-and-white working, and negative and black-and-white print light-sensitive materials.

Methods for exposing the heat developable light-sensitive material to record images include, for example, methods of exposing printing originals such as reversal films through contact screens or color separation filters by use of process cameras, methods using process printers, methods of allowing xenon lamps, light emitting diodes, various lasers (such as laser diodes and gas lasers) to emit light, thereby scan-exposing image information converted to electric signals or image information on CRTs by use of scanners, image setters or facsimiles (the methods described in JP-A-2-129625, JP-A-5-176144, JP-A-5-199372 and JP-A-6-127021), methods of exposing by the combination of X-rays emitted from X-ray tubes and fluorescent intensifying screens, methods of directly taking landscape photographs or human subject photographs by use of cameras, and methods of exposing the light-sensitive materials through reversal films or negative films by use of printers or enlargers.

As light sources for recording images on the heat developable light-sensitive material, xenon lamps, tungsten lamps, halogen lamps, metal halide lamps, quartz lamps, light emitting diodes and laser light sources.

Examples of exposing device for use in the present invention include DC series of Linotype-Hell Co. and Magnascan series of Crosfield Co. which are commercial Ar laser exposing devices, SG series of Dainippon Screen Mfg. Co., Ltd. which are He-Ne laser exposing devices, Lux Scan laser exposing devices of Fuji Photo Film Co., Ltd., color scanners such as MTR of Dainippon Screen Mfg. Co., Ltd., image setters such as Selectset (He-Ne) and Avantra (Red-LD) of Agfa-Gevaert Co., Herkules (Red-LD) of Linotype-Hell Co., Dolev (He-Ne) of Scitex Co., Accuset (Red-LD) of Agfa-Gevaert Co. and Lux Setter 5600 of Fuji Photo Film Co., Ltd., exposing devices for facsimiles such as GX-2010 of Matsushita Graphic Communication Systems, Inc., infrared laser devices including photocomposing-composing devices such as Lux Scan laser exposing devices of Fuji Photo Film Co., Ltd., color scanners such as MTR of Dainippon Screen Mfg. Co., Ltd., Linotronic 200, 230 and 260 of Linotype-Hell Co., KX series of Kyushu Matsushita Electric Co., Ltd., SAPLS Michi and SAPLS 310 of Shaken Co., UX-94 of ULTER Co., CG 9400 and CG 9800 of Compugraphic Co. and VT-4300 and VT-5300 of Varityper Co., black-and-white scanners such as Scanart 450 and Scanart 330 of Fuji Photo Film Co., Ltd. and FX-550 of Toray Industries Inc., exposing devices for newspaper facsimiles such as FT-210, FT-240R and FT-260R of NEC Corp., and medical laser imager devices such as FL-IM D (magazine type) of Fuji Photo Film Co., Ltd., MATRIX LR 3300 of Agfa-Gevaert Co., LM-1A and LM-10 of Canon Inc., M959 and M959 HG of Minesota Mining and Manufacturing Co., KELP-100, KELP-100XLP, KELP-2180 and KELP-1120 of Eastman Kodak Co., Li-10A and Li-7 of Konica Corp., LINX LP400 of du Pont co. and ELSCAN EL-1000 of Nishimoto Sangyo Co. Ltd.

Examples of the process printers which can be utilized in the present invention include FPA 740, FPA 800, FPA 800X, FPA 800Hg and FPA 800FX of Fuji Photo Film Co., Ltd., P607 series, P617 series, P627 series, P647 series and P648 series of Dainippon Screen Mfg. Co., Ltd., IPB-1000SH of Eyegraphics Co. Ltd., FL 2M and FL 3M of Ushio Inc., SK-16 of Kuranami Co., Versalite Contact Printer 840H and Contact 2200 Printer of Eastman Kodak Co., CDL 2002Ri of Agfa-Gevaert Co., P-6, P-4, P-2 and P-8 of Kitamura Co., OR 30 of SACK Co., VDM 5 of THIEMER Co. and RD 7087D of CONVAC Co.

Examples of the process cameras which can be utilized in the present invention include FCS 820, FCS 820S, FCC 100, FCC 200 and FCC 300 of Fuji Photo Film Co., Ltd., FINE ZOOM 880, ZOOMACE 800, Companica C-680, Companica C-690, P648 series and P607 series of Dainippon Screen Mfg. Co., Ltd., Imagemaker 540 of Itech Graphics Co., Opti-Copy 32, Opti-Copy 42, Opti-Copy 23, Imagemaker 5060A, Imagemaker IM200, Imagemaker IM400, Imagemaker IM600 and Imagemaker IM800 of Eastman Kodak Co., RPS camera series and Repromaster series of Agfa-Gevaert Co., Reneas 2000 and Design Scope series of Izumiya Co. and Repro camera series of Mitsubishi Paper Mills Ltd.

The heat developable light-sensitive material and/or the processing sheet for use in the present invention may have conductive heating layers as heating means for heat development and diffusion transfer of silver salts. In this case, heating elements described in JP-A-61-145544 can be utilized.

In the present invention, it is preferred that heating be carried out in the presence of a trace amount of water to conduct development and transfer at the same time as described in U.S. Pat. Nos. 4,704,345 and 4,740,445, and JP-A-61-238056. In this system, the heating temperature is preferably 50° C. to 100° C.

In the present invention, any water may be used as long as it is generally used. Specifically, distilled water, tap water, well water or mineral water can be used. In heat developing equipment in which the light-sensitive materials and the processing sheets are processed, water may be used in the disposable form, or repeatedly circulated. The latter case results in use of water containing components eluted from the light-sensitive materials. Further, equipment and water described in JP-A-63-144354, JP-A-63-144355, JP-A-62-

38460 and JP-A-3-210555 may be used. Furthermore, water may contain water-soluble low boiling solvents, surfactants, antifoggants, complex forming compounds with slightly soluble metal salts, antifungal agents or microbiocides.

These water can be applied to either or both of the light-sensitive material and the processing sheet, but preferably applied to the light-sensitive material. The amount thereof used may be the weight of solvent corresponding to the maximum swelled volume of the whole coated films or less.

Preferred examples of methods for giving water include methods described in JP-A-62-253159, page 5, and JP-A-63-85544. Further, solvents enclosed in microcapsules or hydrated can be previously contained in either or both of the heat developable light-sensitive material or the dye fixing element.

The temperature of water to be applied may be 30° C. to 60° C. as described in JP-A-63-85544. In particular, in order to prevent bacteria in water from propagating, it is useful to keep the temperature of water at 45° C or more.

Hydrophilic heat solvents which are solid at ordinary temperature and soluble at high temperatures can be contained in the light-sensitive material and/or the processing sheet. The solvents may be contained in any of the light-sensitive silver halide emulsion layers, the intermediate layers and the protective layers of the light-sensitive material, and any layers of the processing sheet. Examples of the hydrophilic heat solvents include urea derivatives, pyridine derivatives, amides, sulfonamides, imides, alcohols, oximes and other heterocyclic compounds.

Heating methods in the development and/or transfer stage include methods of bringing the light-sensitive material and the processing sheet into contact with heated blocks, heated plates, hot pressers, heat rolls, heat drums, halogen lamp heaters and infrared or far infrared lamp heaters, and methods of passing them through atmospheres of high temperatures.

The heat developable light-sensitive material can be laminated with the processing sheet by the methods described in JP-A-62-253159 and JP-A-61-147244, page 27.

Any of various heat development devices can be used for processing the photographic elements in the present invention. For example, devices described in JP-A-59-75247, JP-A-59-177547, JP-A-59-181353, JP-A-60-18951, JP-A-U-62-25994 (the term "JP-A-U" as used herein means an "unexamined published Japanese utility model application"), JP-A-6-130509, JP-A-6-95338, JP-A-6-95267.

As commercially available devices, Pictrostat 100, Pictrostat 200, Pictrostat 300, Pictrography 3000 and Pictrography 2000 manufactured by Fuji Photo Film Co., Ltd. can be used.

The present invention will be described in more detail below with reference to the following Examples, but the invention should not be construed as being limited thereto.

EXAMPLE 1

Preparation of Liqht-Sensitive Silver Halide Emulsion (1)

Solution (I) and solution (II) having the compositions shown in Table 2 were concurrently added to an aqueous solution (pH 4) of gelatin having the composition shown in Table 1 over a period of 9 minutes with sufficient stirring. Five minutes after that, solution (III) and solution (IV) were concurrently added over a period of 10 minutes.

TABLE 1

| Composition of Aqueous Solution of Gelatin | |
|---|---|
| $H_2O$ | 650 ml |
| Lime-Treated Gelatin | 10 g |
| NaCl | 1.0 9 |
| Citric Acid | 0.45 g |
| Solvent for Silver Halide (1) | 0.010 g |
| Temperature | 40° C. |
| Solvent for Silver Halide (1) | |

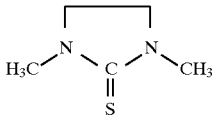

TABLE 2

| | Solution I | Solution II | Solution III | Solution IV |
|---|---|---|---|---|
| $AgNO_3$ | 50 g | — | 50 g | — |
| NaCl | — | 20.17 g | — | 25.3 g |
| XBr | — | 0.81 g | — | 1.05 g |
| Potassium Hexachloro-iridiate (III) | | | | 175 μg |
| $(NH_4)_2RhCl_5(H_2O)$ | | 210 μg | | |
| Yellow Prussiate | | | | 5.28 mg |
| Total Amount | Water to make 244 ml | Water to make 244 ml | Water to make 150 ml | Water to make 150 ml |

After conventional washing and salt removal (conducted using precipitant (1), adjusting the pH to 3 with sulfuric acid), 22 g of lime-treated gelatin was added. After adjustment to pH 6.1 and pAg 7.1, preservative (1) was added, and chemical sensitization was conducted at 60° C. Compounds used in the chemical sensitization were successively added as shown in Table 3. Thus, a cubic silver chloride emulsion having a grain size (a mean side length) of 0.19 μm, a standard deviation of 0.019 μm and a silver bromide content of 1.7 mol % was obtained. The yield of this emulsion was 635 g. In Table 3, preservative (2) is phenoxyethanol.

TABLE 3

| Agent Used in Chemical Sensitization | Amount Added |
|---|---|
| Sensitizing Dye (1) | 264 mg |
| Sensitizing Dye (2) | 53 mg |
| Silver Bromide Emulsion (2) | 18 g |
| Sodium Benzenethiosulfonate | 0.6 mg |
| Sodium Benzenethiosulfinate | 0.15 mg |
| Sodium Chloride | 900 mg |
| Sodium Thiosulfate Pentahydrate | 3.6 mg |

TABLE 3-continued

| Agent Used in Chemical Sensitization | Amount Added |
|---|---|
| Chloroauric Acid | 7.7 mg |
| Potassium Thiocyanate | 30 mg |
| Mercapto Compound (1) | 171 mg |
| Preservative (2) | 3 g |
| pH 6.1, pAg 7.1 | |

Precipitant (1)

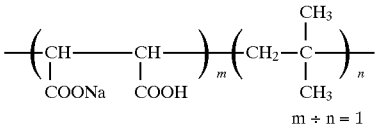

Preservative (1)

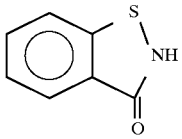

Sensitizing Dye (1)

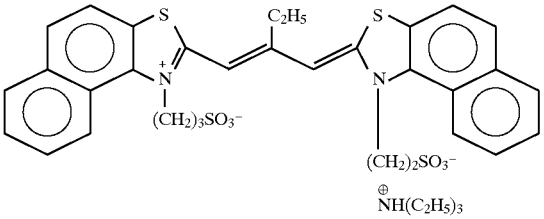

Sensitizing Dye (2)

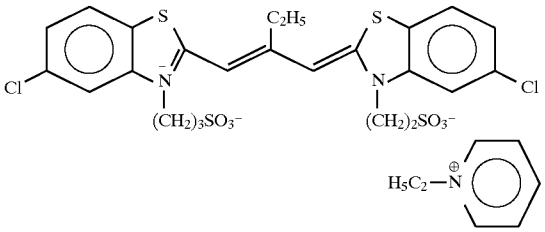

Mercapto Compound (1)

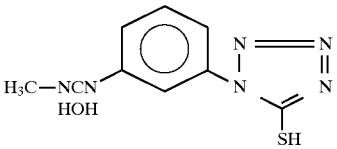

Preparation of Silver Bromide Grain Emulsion (2) in Table 3

The temperature of an aqueous solution of gelatin having the composition shown in Table 4 was lowered to 30° C. with sufficient stirring, and solution (I) and solution (II) shown in Table 5 were concurrently added thereto over a period of 3 minutes and 40 seconds. Five minutes after that, solution (III) and solution (IV) were concurrently added over a period of 2 minutes, adjusting the flow rate of solution (IV) so as to give a silver potential of 50 mV.

TABLE 4

| Composition of Aqueous Solution of Gelatin | |
|---|---|
| $H_2O$ | 1120 ml |
| Lime-Treated Gelatin | 40 g |
| KBr | 3 g |
| Acetic Acid (100%) | 3.5 ml |
| Temperature | 40° C. |

TABLE 5

| | Solution I | Solution II | Solution III | Solution IV |
|---|---|---|---|---|
| $AgNO_3$ | 35 g | — | 65 g | — |
| KBr | — | 24.6 g | — | 49.4 g |
| Potassium Hexachloro-iridiate (IV) | | | | 11 mg |
| Total Amount | Water to make 175 ml | Water to make 183 ml | Water to make 325 ml | Water to make 350 ml |

After conventional washing and salt removal (conducted using precipitant (1), adjusting the pH to 4.1 with phosphoric acid), 22 g of lime-treated gelatin was added to adjust an emulsion to pH 6.1 and pAg 7.8 (with KBr). Preservative (2) was used as a preservative. Thus, a cubic silver chloride emulsion having a grain size of 0.05 μm was obtained. The yield was 630 g.

Preparation of Coating Solution for Emulsion Layer of Liqht-Sensitive Material 101

Three ml of a methanol solution containing 10 mg of sensitizing dye (3) was added to 100 g of emulsion (1), and 0.25 ml of a 1% methanol solution of disodium 4,4-bis[4,6-di(naphthyl-2-oxy)pyrimidine-2-ylamino]stilbene-2,2'-disulfonate, 6 ml of a 0.8% methanol solution of antifoggant (2), 0.2 g of surfactant (1) and 0.25 g of water-soluble polymer (1) were added thereto. Then, 15 ml of a 10% solution of p-tert-butylcatechol in a water-methanol mixed solvent (water/methanol volume ratio=7/3) was further added to obtain a coating solution for an emulsion layer of light-sensitive material 101. The coating solution was applied so as to give a silver amount of 1.4 g/m$^2$.

Sensitizing Dye (3)

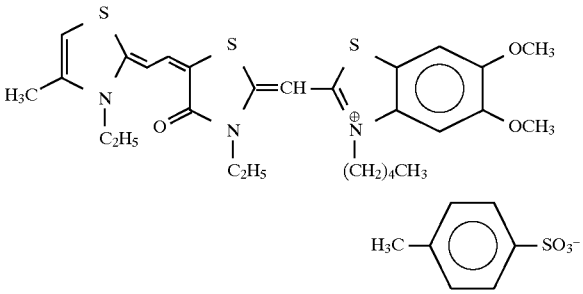

Antifoggant (2)

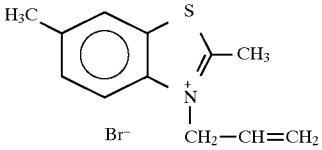

Water-Soluble Polymer (1)

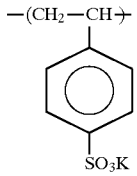

-continued

Surfactant (1)

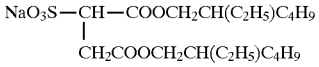

Preparation of Dispersion of Reducing Agent, 1,5-Diphenyl-3-pyrazolidone

Ten grams of 1,5-diphenyl-3-pyrazolidone and 0.2 g of Demol manufactured by Kao Corp. were added to 90 ml of 5.7% lime-treated gelatin, and dispersed by use of glass beads having a mean particle size of 0.75 mm in a mill for 30 minutes. The glass beads were separated to obtain a gelatin dispersion of the reducing agent.

Preparation of Dispersion of Zinc Hydroxide

To 100 ml of a 4% aqueous solution of gelatin, 12.5 g of zinc hydroxide having a mean particle size of 0.2 $\mu$m, 1 g of carboxymethyl cellulose as a dispersing agent, and 0.1 g of polysodium acrylate were added, and dispersed by use of glass beads having mean particle size of 0.75 mm in a mill for 30 minutes. The glass beads were separated to obtain a gelatin dispersion of zinc hydroxide.

Preparation of Dispersion of Leuco Dye and Developer

A dispersion of a leuco dye and a developer was prepared as shown in Table 6. The oily phase components melted by heating at about 60° C. were added to the aqueous phase components heated at 60° C., and mixed by stirring, followed by dispersing at 10000 rpm with a homogenizer for 10 minutes. Then, water was added to obtain a homogeneous dispersion.

TABLE 6

| | |
|---|---|
| Oily Phase | |
| Leuco Dye | 1.96 g |
| Developer | 2.46 g |
| Surfactant (1) | 230 mg |
| Ethyl Acetate | 11 ml |
| Aqueous Phase | |
| Lime-Treated Gelatin | 3.3 g |
| Preservative (1) | 14 mg |
| Water | 35 ml |
| Addition of Water after Emulsification | |
| Water | 46 ml |

Leuco Dye

TABLE 6-continued

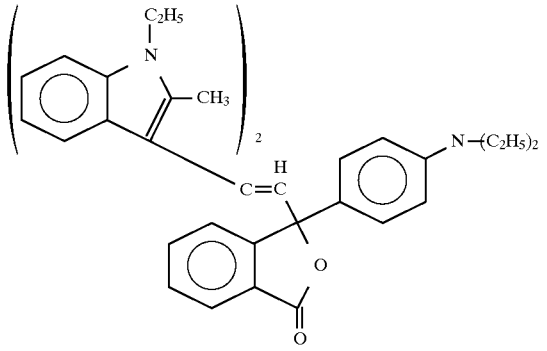

Developer

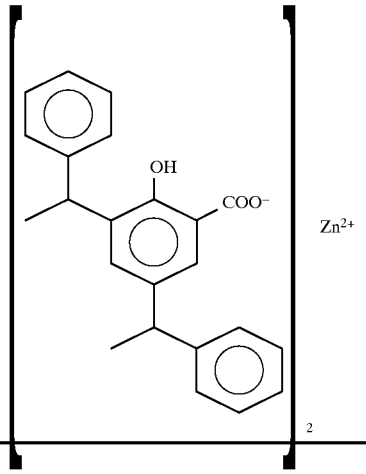

Using the foregoings, light-sensitive material 101 shown in Table 7 was prepared.

TABLE 7

Constitution of Light-Sensitive Material 101

| Layer Name | Additive | Amount Coated ($mg/m^2$) |
|---|---|---|
| 4th Layer (Protective Layer) | Acid-Treated Gelatin | 172 |
| | PMMA Latex (diameter: 3 $\mu$m) | 12 |
| | Preservative (1) | 1 |
| | Sumikagel L-5H (manufactured by Sumitomo Chemical) | 64 |
| | Calcium Sulfate | 3 |
| | Surfactant (1) | 5 |
| | Surfactant (2) | 1 |
| 3rd Layer (Emulsion Layer) | Light-Sensitive Silver Halide Emulsion Grains | 1400 (in terms of silver) |
| | Lime-Treated Gelatin | 700 |
| | Surfactant (1) | 28 |
| | Water-Soluble Polymer (1) | 28 |
| | Stabilizer, Antifoggant | Described in the description |
| | Sensitizing Dye | Described in the description |
| 2nd Layer (Intermediate Layer) | 1,5-Diphenyl-3-pyrazolidone | 1657 |
| | Lime-Treated Gelatin | 828 |
| | Dextran | 62 |
| | Hardener (1) | 35 |
| | Surfactant (1) | 7 |
| | Water-Soluble Polymer (1) | 10 |

TABLE 7-continued

Constitution of Light-Sensitive Material 101

| Layer Name | Additive | Amount Coated ($mg/m^2$) |
|---|---|---|
| 1st Layer (Antihalation Layer) | Lime-Treated Gelatin | 660 |
| | Leuco Dye | 220 |
| | Developer | 276 |
| | Zinc Hydroxide | 900 |
| | Zinc Thiosalicylate | 36 |
| | Surfactant (1) | 26 |
| | Water-Soluble Polymer (1) | 7 |
| Support: Polyethylene Terephthalate (having a gelatin undercoat and a thickness of 100 $\mu$m) | | |
| 1st Back Coat Layer (Conductive Layer) | Lime-Treated Gelatin | 60 |
| | Fine Particles of Tin Oxide-Antimony Oxide Complex having a Mean Particle Size of 0.005 $\mu$m (specific resistance: 5Ω, secondary agglomerate size: 0.08 $\mu$m) | 180 |
| | Polyoxyethylene-p-nonylphenol (degree of polymerization: 10) | 5 |
| 2nd Back Coat Layer | Lime-Treated Gelatin | 2000 |
| | Surfactant (1) | 11 |
| | Hardener (2) | 455 |
| | PMMA Latex (diameter: 6 $\mu$m) | 9 |
| 3rd Back Coat Layer | Copolymer of Methyl Methacrylate/Styrene/2-Ethylhexyl Acrylate/Methacrylic Acid | 1000 |
| | Surfactant (1) | 1.5 |
| | Surfactant (3) | 20 |
| | Surfactant (4) | 2.5 |

TABLE 7-continued

Constitution of Light-Sensitive Material 101

| Layer Name | Additive | Amount Coated ($mg/m^2$) |
|---|---|---|
| Surfactant (2) | | |
| $C_8F_{17}SO_2N(C_3H_7)CH_2COOK$ | | |
| Surfactant (3) | | |
| $C_{16}H_{33}OSO_3Na$ | | |
| Surfactant (4) | | |
| $C_8F_{17}SO_3K$ | | |
| Hardener (1) | Hardener (2) | |
| $CH_2{=}CHSO_2CH_2SO_2CH{=}CH_2$ | $(CH_2)_2{-}(O{-}CH_2{-}\overset{O}{\overset{/\backslash}{CH{-}CH}}{-}CH_2)_2$ | |

Preparation of Silver Colloid Dispersion

To a well-stirred solution shown in Table 8, 170 ml of an aqueous solution containing 17 g of silver nitrate was added for 25 minutes. Then, gelatin was added thereto. After conventional washing and salt removal (conducted using precipitant (1), adjusting the pH to 3 with sulfuric acid), lime-treated gelatin was added to adjust the pH to 6.1. Then, preservative (1) was added and dispersed therein. A dispersion having a mean particle size of 0.02 $\mu$m, a silver content of 4%, and a gelatin content of 2% was obtained. The yield was 263 g.

TABLE 8

| | |
|---|---|
| $H_2O$ | 620 ml |
| Dextrin | 16 g |
| Sodium Hydroxide | 8.2 g |
| Temperature | 30° C. |

Preparation of Dispersion of High Boiling Solvent (1)

A dispersion of high boiling solvent (1) was prepared as shown in Table 9. The oily phase components melted by heating at about 60° C. were added to the aqueous phase components heated at 60° C., and mixed by stirring, followed by dispersing at 10000 rpm with a homogenizer for 10 minutes. Then, water was added to obtain a homogeneous dispersion. The particle size of the high boiling organic solvent was 0.3 $\mu$m.

TABLE 9

| | |
|---|---|
| Oily Phase | |
| High Boiling Solvent (1) | 18 g |
| Surfactant (1) | 2.3 g |
| Ethyl Acetate | 9 ml |
| Aqueous Phase | |
| Lime-Treated Gelatin | 9 g |
| Preservative (1) | 45 mg |
| Water | 56 ml |
| Addition of Water after Emulsification | |
| Water | 9 ml |

TABLE 9-continued

High Boiling Solvent

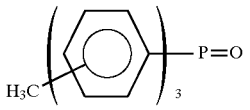

Then, processing sheet R-1 as shown in Table 10 was prepared.

TABLE 10

Constitution of Processing Sheet R-1

| Layer Name | Additive | Amount Coated ($mg/m^2$) |
|---|---|---|
| 4th Layer (Physical Development Nucleus-Containing Layer) | K Carageenan | 60 |
| | Sumikagel L-5H (manufactured by Sumitomo Chemical) | 65 |
| | Lime-Treated Gelatin | 125 |
| | Surfactant (1) | 7 |
| | Surfactant (2) | 25 |
| | Surfactant (5) | 60 |
| | Fine Particles of Silver Colloid (size: 0.02 $\mu$m) | 10 |
| | Potassium Nitrate | 28 |
| | PMMA Latex (diameter: 12 $\mu$m) | 9 |
| 3rd Layer (Intermediate Layer) | Lime-Treated Gelatin | 195 |
| | Preservative (1) | 0.7 |
| | Hardener (2) | 160 |
| | Sumikagel L-5H (manufactured by Sumitomo Chemical) | 15 |
| | Surfactant (1) | 9 |
| 2nd Layer (Complexing Agent Layer) | Lime-Treated Gelatin | 3331 |
| | High Boiling Organic Solvent (1) | 2826 |
| | Dextran | 860 |
| | Polymer (1) | 1731 |
| | Guanidine Picolinate | 3000 |
| | Quinolinates (molar ratio of potassium/sodium: 1/1) | 300 |
| | Preservative (1) | 8 |
| | Potassium Hydantoate | 1020 |
| | Surfactant (1) | 22 |
| 1st Layer (Intermediate Layer) | Lime-Treated Gelatin | 195 |
| | Preservative (1) | 0.7 |
| | Hardener (2) | 160 |
| | Sumikagel L-5H (manufactured by Sumitomo Chemical) | 15 |
| | Surfactant (1) | 9 |
| Support: Polyethylene Terephthalate (having a gelatin undercoat and a thickness of 70 $\mu$m) | | |
| Back Coat Layer | Lime-Treated Gelatin | 1183 |
| | Preservative (1) | 6 |
| | Water-Soluble Polymer (1) | 75 |
| | Surfactant (1) | 127 |
| | Benzoguanamine Resin (particle size: 11 $\mu$m) | 170 |
| | Hardener (2) | 190 |

Surfactant (5)

$$C_{11}H_{23}CONHCH_2CH_2CH_2\overset{+}{N}(CH_3)_2CH_2COO^-$$

TABLE 10-continued

| Constitution of Processing Sheet R-1 | | |
|---|---|---|
| Layer Name | Additive | Amount Coated ($mg/m^2$) |
| | Polymer (1) 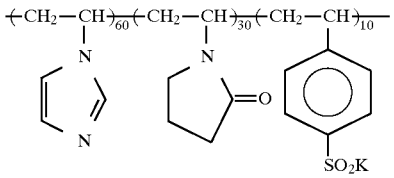 | |

Processing sheets R-2 to R-9 were prepared by changing the physical development nucleus-containing layer as shown in Table 11 below. The amount of the binders contained in the physical development nucleus-containing layer was controlled so as to give a constant gelatin/K carageenan/Sumikagel L-5H ratio.

In processing sheets R-2 and R-9, PMMA latex was eliminated. The contact angle was controlled by the amount of surfactant (2). The contact angle was measured by the drop method at 40° C. with a contact angle meter manufactured by Kyowa Kaimen Kagku Co.

TABLE 11

| Processing Sheet | | Matting Agent | Amount of Binder (a) (mg) | Amount of Physical Development Nucleus (b) (mg) | Size (c) ($\mu m$) | (b)/((a) × (c)) ($\mu m^{-1}$) | Contact Angle (°) |
|---|---|---|---|---|---|---|---|
| R-1 | Comparison | Used | 250 | 10 | 0.02 | 2 | 65 |
| R-2 | Comparison | Not used | 250 | 10 | 0.02 | 2 | 54 |
| R-3 | Comparison | Used | 500 | 10 | 0.02 | 1 | 62 |
| R-4 | Comparison | Used | 100 | 10 | 0.02 | 5 | 76 |
| R-5 | Invention | Used | 100 | 10 | 0.02 | 5 | 55 |
| R-6 | Invention | Used | 100 | 10 | 0.02 | 5 | 48 |
| R-7 | Invention | Used | 100 | 10 | 0.02 | 5 | 36 |
| R-8 | Invention | Used | 100 | 10 | 0.02 | 5 | 28 |
| R-9 | Comparison | Not used | 100 | 10 | 0.02 | 5 | 57 |

Light-sensitive material 101 was exposed changing the quantity of light at a ten millionth of a second per picture element (40 $\mu m^2$) by use of a semiconductor laser having a peak at 670 nm. The light-sensitive material exposed was immersed in water maintained at 40° C. for 2.5 seconds, followed by squeezing with rolls, and immediately, processing sheet R-1 was placed thereon so that a film surface thereof comes into contact with the processing sheet. Subsequently, the light-sensitive material was heated for 22 seconds by use of a heat drum adjusted to such a temperature that the temperature of the water-absorbed film surface was elevated to 80° C. When processing sheet R-1 was peeled off, a black-and-white image was obtained on the light-sensitive material.

A characteristic curve showing the relationship between the UV density of the transmission image and the exposure amount was obtained by use of an automatic densitometer. From this characteristic curve, the maximum density Dmax and the minimum density Dmin were determined.

Processing sheets R-2 to R-9 were similarly processed, and the density unevenness in Dmin areas was visually evaluated.

The evaluation standard is as follows:

○: Scarcely observed; Δ: Acceptable; x: No good

In processing sheets R-2 and R-9, the uneven adhesion was developed after coating and winding-up. On the other hand, in processing sheets R-1 arid R-3 to R-8 each containing the matting agent, PMMA, no uneven adhesion was developed.

TABLE 12

| | Dmin | Dmax | Density unevenness in Dmin |
|---|---|---|---|
| R-1 | 0.25 | 3.55 | ○ |
| R-2 | 0.18 | 3.54 | ○ |
| R-3 | 0.35 | 3.56 | ○ |
| R-4 | 0.16 | 3.56 | x |
| R-5 | 0.16 | 3.57 | Δ |
| R-6 | 0.16 | 3.58 | ○ |
| R-7 | 0.17 | 3.57 | ○ |
| R-8 | 0.16 | 3.57 | ○ |
| R-9 | 0.16 | 3.55 | Δ |

The results shown in Table 12 indicate that the light-sensitive materials heat-developed using the processing sheets large in the product of the weight ratio of the amount of the physical development nuclei to that of the binder and the reciprocal of the mean size ($\mu m$) of the physical development nuclei and little in contact angle, have low Dmin and high Dmax and no density unevenness in the Dmin areas. Further, since the matting agent was used, image unevenness caused by poor adhesion was not observed.

EXAMPLE 2

In the formulation of processing sheet R-1, the physical development nucleus-containing layer was changed as shown in Table 13 to prepare processing sheets R-10 to 16. The contact angle was adjusted by the amount of surfactant (2) within the range of 32° to 37°.

The amount of the binder contained in the physical development nucleus-containing layer was controlled so as to give a constant gelatin/K carageenan/Sumikagel L-5H ratio.

TABLE 13

| Processing Sheet | | Amount of Binder (a) (mg) | Amount of Physical Development Nucleus (b) (mg) | Size (c) (μm) | (b)/((a) × (c)) ($\mu m^{-1}$) |
|---|---|---|---|---|---|
| R-7 | Invention | 100 | 10 | 0.02 | 5 |
| R-10 | Invention | 200 | 20 | 0.02 | 5 |
| R-11 | Invention | 50 | 10 | 0.02 | 10 |
| R-12 | Invention | 100 | 20 | 0.02 | 10 |
| R-13 | Invention | 200 | 40 | 0.02 | 10 |
| R-14 | Invention | 20 | 2 | 0.02 | 5 |
| R-15 | Invention | 500 | 100 | 0.02 | 10 |
| R-16 | Comparison | 1000 | 200 | 0.02 | 10 |

Light-sensitive material 101 was processed by use of processing sheets R-7 and R-10 to R-16 in the same manner as in Example 1. The results obtained are shown in Table 14.

TABLE 14

| | Dmin | Dmax |
|---|---|---|
| R-7 | 0.17 | 3.57 |
| R-10 | 0.19 | 3.58 |
| R-11 | 0.15 | 3.56 |
| R-12 | 0.16 | 3.56 |
| R-13 | 0.17 | 3.57 |
| R-14 | 0.16 | 3.58 |
| R-15 | 0.22 | 3.57 |
| R-16 | 0.25 | 3.56 |

Even at a constant amount of the physical development nucleus, the higher product of the weight ratio of the amount of the physical development nucleus to that of the binder and the reciprocal of the mean size (μm) of the physical development nucleus results in the lower Dmin. Further, the results show that the larger amount of the binder contained in the physical development nucleus-containing layer results in the higher Dmin.

EXAMPLE 3

A solution obtained by dissolving 1 g of palladium chloride in 8 ml of 38% HCl and adding 592 ml of water thereto was added to 600 ml of a 9% well-stirred aqueous solution (50° C.) of lime-treated gelatin containing 1.8 g of sodium sulfide nonahydrate over a period of 2 minutes to prepare a dispersion of palladium sulfide in gelatin. The particle size thereof was 0.001 μm.

A dispersion of silver sulfide in gelatin was prepared in the same manner as in the palladium sulfide dispersion formulation, except that 600 ml of a solution containing 0.95 g of silver nitrate was used in place of the hydrochloric acid-containing solution of palladium chloride.

A dispersion of silver selenide in gelatin was prepared in the same manner as in the silver sulfide dispersion formulation, except that 1.8 g of sodium sulfide nonahydrate was substituted by 0.94 g of sodium selenide.

A dispersion of silver sulfoselenide was prepared in the same manner as in the silver sulfide dispersion formulation, except that the amount of sodium sulfide was changed to 0.9 g and 0.46 g of sodium selenide was added. As a result of X-ray diffraction, no diffraction peaks of silver sulfide and silver selenide were detected, and a diffraction peak of a substance assumed to be a compound of silver sulfide and silver selenide was obtained.

A dispersion of silver colloid coated with gold was prepared in the same manner as in the colloidal silver dispersion formulation of R-14, except that 100 ml of a monovalent gold ion aqueous solution (heated at 80° C.) containing 0.412 g of chloroauric acid tetrahydrate and 5.15 g of sodium thiocyanate were further added before addition of gelatin.

In the formulation of processing sheet R-1, the physical development nucleus-containing layer was changed as shown in Table 15, using the above-described physical development nucleus, to prepare processing sheets R-17 to R-21. The contact angle was adjusted by the amount of surfactant (2) within the range of 27° to 38°.

TABLE 15

| Processing Sheet | | | Amount of Binder (a) (mg) | Amount of Physical Development Nucleus (b) (mg) | Size (c) (μm) | (b)/((a) × (c)) ($\mu m^{-1}$) |
|---|---|---|---|---|---|---|
| R-14 | (Invention) | Silver Colloid | 20 | 2 | 0.02 | 5 |
| R-17 | (Invention) | Palladium Sulfide | 400 | 2 | 0.001 | 5 |
| R-18 | (Invention) | Silver Sulfide | 200 | 2 | 0.002 | 5 |
| R-19 | (Invention) | Silver Selenide | 400 | 2 | 0.001 | 5 |
| R-20 | (Invention) | Silver Sulfoselenide | 400 | 2 | 0.001 | 5 |
| R-21 | (Invention) | Silver Colloid coated with Gold | 20 | 2 | 0.02 | 5 |

Using processing sheets R-14 and R-17 to R-21, light-sensitive material 101 was processed in the same manner as in Example 1. The results obtained are shown in Table 16.

TABLE 16

| | Dmin | Dmax | Dmax-Dmin |
|---|---|---|---|
| R-14 | 0.16 | 3.58 | 3.42 |
| R-17 | 0.17 | 3.67 | 3.50 |
| R-18 | 0.20 | 3.63 | 3.43 |
| R-19 | 0.16 | 3.45 | 3.29 |
| R-20 | 0.16 | 3.64 | 3.48 |
| R-21 | 0.15 | 3.60 | 3.45 |

The results shown in Table 16 reveal that use of the chalcogenides such as palladium sulfide as the physical development nuclei can also attain high Dmax and low Dmin according to the present invention.

Use of the chalcogenides as the physical development nuclei permits to obtain the higher Dmax. Further, the results also show that high Dmax and low Dmin are obtained by use of the chalcogenide of mixed crystal or surface modification.

EXAMPLE 4

Light-sensitive material 401 was prepared in the same manner as in Example 1, except that compound (II)-2 was added in an amount of 45 mg/m$^2$ to the second layer of light-sensitive material 101. Using this light-sensitive material, an image was formed in the same manner as in Example 1, and the resulting image was stored under the conditions of 30° C. and 80% relative humidity for 2 weeks. Examination of the powdering state on a surface of the image at this time reveals that the powdering decreases more significantly than when an image was formed using light-sensitive material 101.

While the invention has been described in detail and with reference to specific examples thereof, it will be apparent to one skilled in the art that various changes and modifications can be made therein without departing from the spirit and scope thereof.

What is claimed is:

1. An image forming method comprising the steps of:

(i) imagewise exposing a silver halide light-sensitive material comprising a support having thereon at least a light-sensitive silver halide emulsion, a hydrophilic binder and a slightly water-soluble basic metal compound;

(ii) laminating the silver halide material with a processing sheet comprising a compound which forms a complex with a metal ion constituting the basic metal compound, a physical development nucleus, a solvent for a silver halide and a matting agent, after or concurrently with the imagewise exposure; and (iii) conducting heat development in the presence of a reducing agent and water to form a silver image on either or both of the light-sensitive material and the processing sheet, wherein the processing sheet comprises an uppermost layer containing the physical development nucleus;

wherein the product of the weight ratio in the uppermost layer of the amount of the physical development nucleus to that of the binder and the reciprocal of the mean size ($\mu$m) of the physical development nucleus is not less than 1.5;

wherein the amount of the binder in the uppermost layer is from 0.001 g/m$^2$ to 0.8 g/m$^2$; and wherein the uppermost layer has a contact angle with respect to water of not more than 60°.

2. The image forming method of claim 1, wherein the silver halide light-sensitive material contains a 1-phenyl-3-pyrazolidone compound and a 5-pyrazolidone compound in at least one of the light-sensitive silver halide emulsion layer or other hydrophilc binder layers.

* * * * *